US006942504B2

(12) United States Patent
Shinozaki et al.

(10) Patent No.: US 6,942,504 B2
(45) Date of Patent: Sep. 13, 2005

(54) CONNECTOR

(75) Inventors: Tetsuya Shinozaki, Yokkaichi (JP); Kiyokazu Takada, Yokkaichi (JP); Hiroshi Nakano, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 67 days.

(21) Appl. No.: 10/705,052

(22) Filed: Nov. 10, 2003

(65) Prior Publication Data

US 2004/0097113 A1 May 20, 2004

(30) Foreign Application Priority Data

Nov. 11, 2002 (JP) ..... 2002-327298
Nov. 12, 2002 (JP) ..... 2002-328399
Nov. 21, 2002 (JP) ..... 2002-338253

(51) Int. Cl.[7] ..... H01R 13/62
(52) U.S. Cl. ..... 439/157
(58) Field of Search ..... 439/157, 372

(56) References Cited

U.S. PATENT DOCUMENTS 5,975,930 A 11/1999 Matsuura et al.
6,068,494 A 5/2000 Tokuwa
6,161,283 A 12/2000 Tokuwa
6,164,991 A * 12/2000 Matsuura et al. ..... 439/157
6,312,273 B1 * 11/2001 Hasegawa et al. ..... 439/157
6,338,636 B2 * 1/2002 Nishioka ..... 439/157
6,764,324 B2 * 7/2004 Shinozaki et al. ..... 439/157
2001/0044228 A1 11/2001 Noro et al.
2002/0019160 A1 2/2002 Takata
2002/0160638 A1 10/2002 Hamai et al.

FOREIGN PATENT DOCUMENTS

JP 5-182716 7/1993
JP 08-177018 7/1996
JP 09-092416 4/1997
JP 09-219254 8/1997
JP 2000-082515 3/2000
JP 2000-260523 9/2000
JP 2002-093525 3/2002

* cited by examiner

*Primary Examiner*—Phuong Dinh
(74) *Attorney, Agent, or Firm*—Gerald E. Hespos; Anthony J. Casella

(57) ABSTRACT

A female connector (10) has a lever (40) in the form of a single plate. The lever (40) is locked at an initial position by a resilient lock (46) before a connecting operation with a male connector (50). An unlocking rib (55) projects from the ceiling surface of a receptacle (53) of the male housing (50) near one side for canceling the locked state of the resilient lock (46) during the connecting operation. An insertion preventing rib (56) projects from the inner surface of the receptacle (53) at a side opposite the unlocking rib (55), and an escape groove (47) for receiving the insertion preventing rib (56) is formed in the upper surface of the lever (40). Thus, the female connector (10) can be prevented from being inserted in a wrong posture.

9 Claims, 32 Drawing Sheets

CONNECTOR

BACKGROUND OF THE INVENTION

1. Field of the Invention

The invention relates to a lever-type connector or a circuit board connector.

2. Description of the Related Art

Japanese Unexamined Patent Publication No. H5-182716 and FIG. 10(A) herein disclose connectors that use the cam action of a lever to reduce a connecting force. With reference to FIG. 10(A) a connector of this type has first and second housings 1, 2. The first housing 1 has a wide box-shape and is fit into a wide receptacle 3 of the second housing 2. A lever 4 is mounted in an upper part of the first housing 1 and has a cam groove (not shown). A cam pin 5 is in the center of the ceiling surface of the receptacle 3 of the second housing 2, and an unlocking rib 6 is provided at the left side of the cam pin 5 when viewed from the front. The lever 4 is locked at an initial position by a locking means (not shown) between the lever 4 and the housing 1 before the housings 1, 2 are connected. The housings 1, 2 then are fit together lightly in this state. Thus, the cam pin 5 engages the entrance of the cam groove of the lever 4 and the unlocking rib 6 unlocks the locking means of the lever 4. The lever 4 then is rotated. As a result, the housings 1, 2 are pulled together and reach a proper connection due to a cam action between the cam pin 5 and the cam groove.

The housing 1 and the lever 4 may be fit into a side of the receptacle 3 where the unlocking rib 6 is not provided, so that the longitudinal axes of the housings 1, 2 are substantially normal, as shown in FIG. 10(B). In such a case, a side wall of the housing 1 may contact and deform the mating terminal fittings in the receptacle 3.

The present invention was developed in view of the above problem and an object thereof is to provide a connector that can prevent a housing from being fitted into a receptacle of a mating housing in a wrong posture.

SUMMARY OF THE INVENTION

The invention relates to a connector having first and second housings. The second housing has a receptacle for receiving the first housing. A movable member is mounted on the first housing for movement from an initial position to an ending position. A locking means also is provided for temporarily locking the movable member in the initial position. The movable member is formed with a cam means for engaging a mating cam means in the receptacle of the second housing. The cam means and the mating cam means cooperate for pulling the housings together as the movable member is moved from the initial position to the ending position. At least one unlocking rib projects from an inner surface of the receptacle. The unlocking rib cancels a locked state effected by the locking means when the first housing is fit lightly into the receptacle. Thus, the movable member can be moved from the initial position to the ending position, and the cam action of the cam means moves the housings into a properly connected condition.

The receptacle preferably is a wide rectangular tube, and the unlocking rib projects from an inner surface of a longer side of the receptacle.

The unlocking rib preferably is near one side of the receptacle, and at least one insertion preventing rib preferably projects in from a side substantially opposite the unlocking rib. The movable member preferably is formed with an escape groove for at least partly receiving the insertion preventing rib when the housings are oriented properly. However, the insertion preventing rib prevents the first housing from being inserted into the receptacle in an improper posture The movable member preferably is a lever rotatably mounted on the first housing.

The first housing preferably is a frame with accommodating chambers for accommodating auxiliary connectors. A rib insertion groove preferably is formed in an outer wall of the first housing for receiving the insertion preventing rib. Accordingly, the divided connector cannot be fit into the receptacle in a wrong orientation.

An insertion preventing wall preferably is formed integrally on a rear surface of the first housing with respect to a fitting direction and projects back from a widthwise end portion. The insertion prevention wall prevents the first housing from being fit into the receptacle from a side different from an engaging surface thereof. Accordingly, the first housing cannot be inserted into the receptacle in an improper orientation where the first housing could contact and deform terminal fittings in the receptacle. The insertion-preventing wall preferably is only at one lateral end position of the first housing. Thus, there is no significant increase in material costs or weight of the connector.

The movable member preferably is a substantially plate-shaped lever that extends along one surface of the first housing with respect to the height direction. In this regard, the height direction extends substantially normal to the forward and backward directions. The insertion-preventing wall prevents the first housing from being inserted into the receptacle from a surface opposite from the movable member or the lever. Accordingly, the first housing is prevented from being fit into the receptacle from the surface opposite the plate-shaped lever.

At least one guide rib preferably is formed on a lateral portion of one end surface of the first housing with respect to the height direction. The guide rib preferably extends substantially along forward and backward directions and is engageable with at least one receiving groove in the receptacle. A step-shaped catch is formed by arranging the guide rib at a position spaced from a lateral end of the first housing. A first housing without a step-shaped catch could be fit deeply fitted into the receptacle and could deform the wall of the receptacle if this portion is pressed strongly against the receptacle. However, the step-shaped catch engages the opening edge of the receptacle, and prevents the first housing from fitting into the receptacle.

Terminal fittings preferably are pierced through a back end wall of the receptacle. Each terminal fitting includes a first portion extending substantially back from the rear surface of the housing and a second portion bent at an angle to the first portion. The terminal fittings are connected electrically with circuits on a circuit board by inserting the leading ends of the second portions through holes formed in the circuit board. Two or more terminal protection walls may be formed unitarily or integrally on the rear surface of the housing to protect the first and second portions of the terminal fittings from opposite sides. The terminal protection walls prevent other members from interfering with the terminal fittings. Thus, the terminal fittings will not be deformed.

The housing may have positioning grooves that extend forward and back to receive the first portions of the respective terminal fittings. Accordingly, the terminal fittings can be aligned with higher precision.

The housing may also have alignment walls to hold opposite sides of the second portions of the respective terminal fittings. Accordingly, each terminal fitting can be aligned with even higher precision. Further, the number of parts can be reduced as compared to a case where a separate member such as an alignment plate is assembled with the housing to position the terminal fittings.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

A lever-type connector assembly according to a first embodiment of the invention is illustrated in FIGS. 1 to 9, and includes a female connector 10 and a male connector 50 that are connectable and separable. In the following description, sides of the respective connectors 10, 50 to be connected with each other are referred to as the front sides and reference is made to FIG. 1 concerning the vertical direction.

Figure 1:
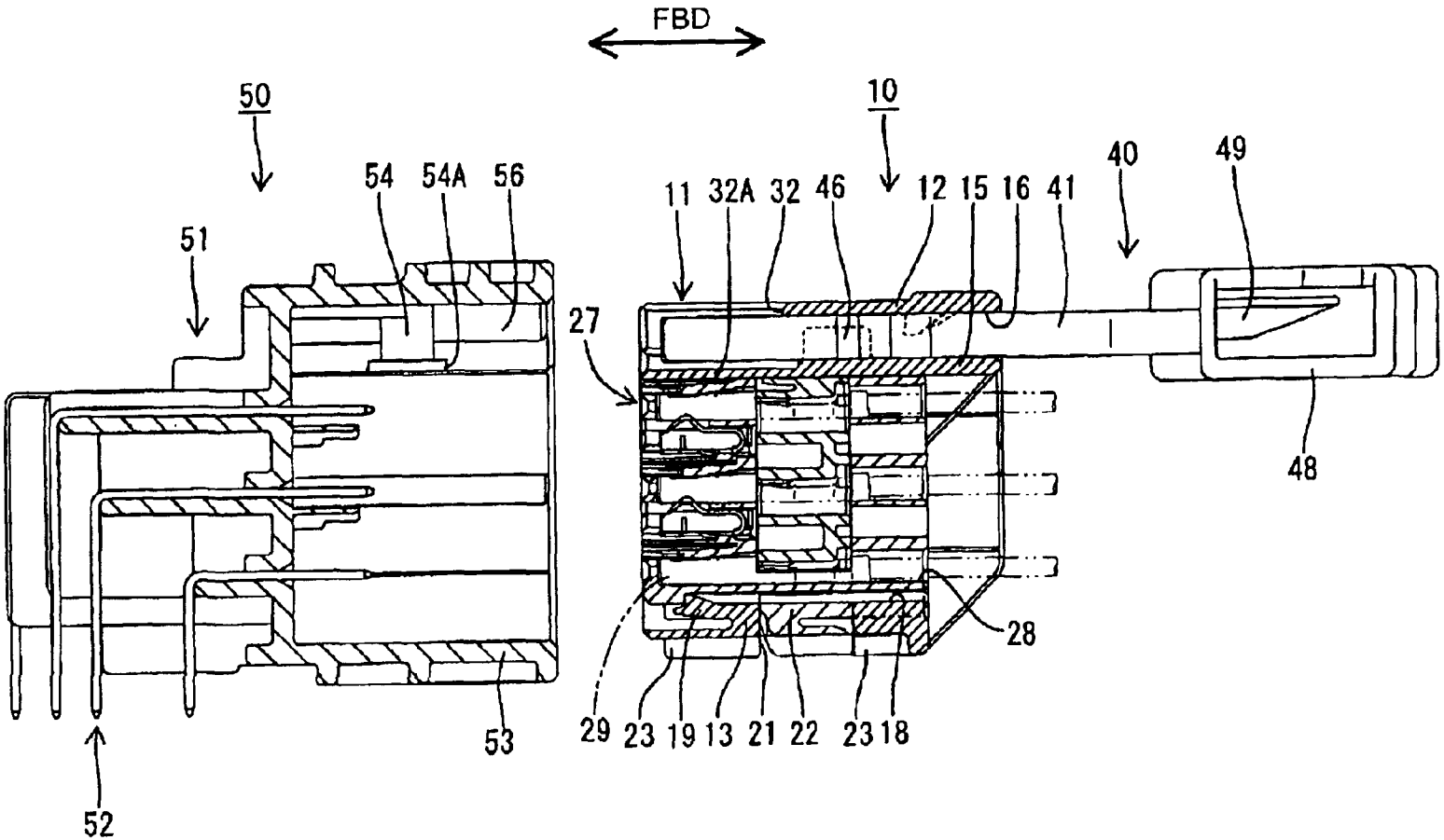
FIG. 1 is a longitudinal section showing a state before a female connector according to one embodiment of the invention and a male connector are connected.
Figure 2:
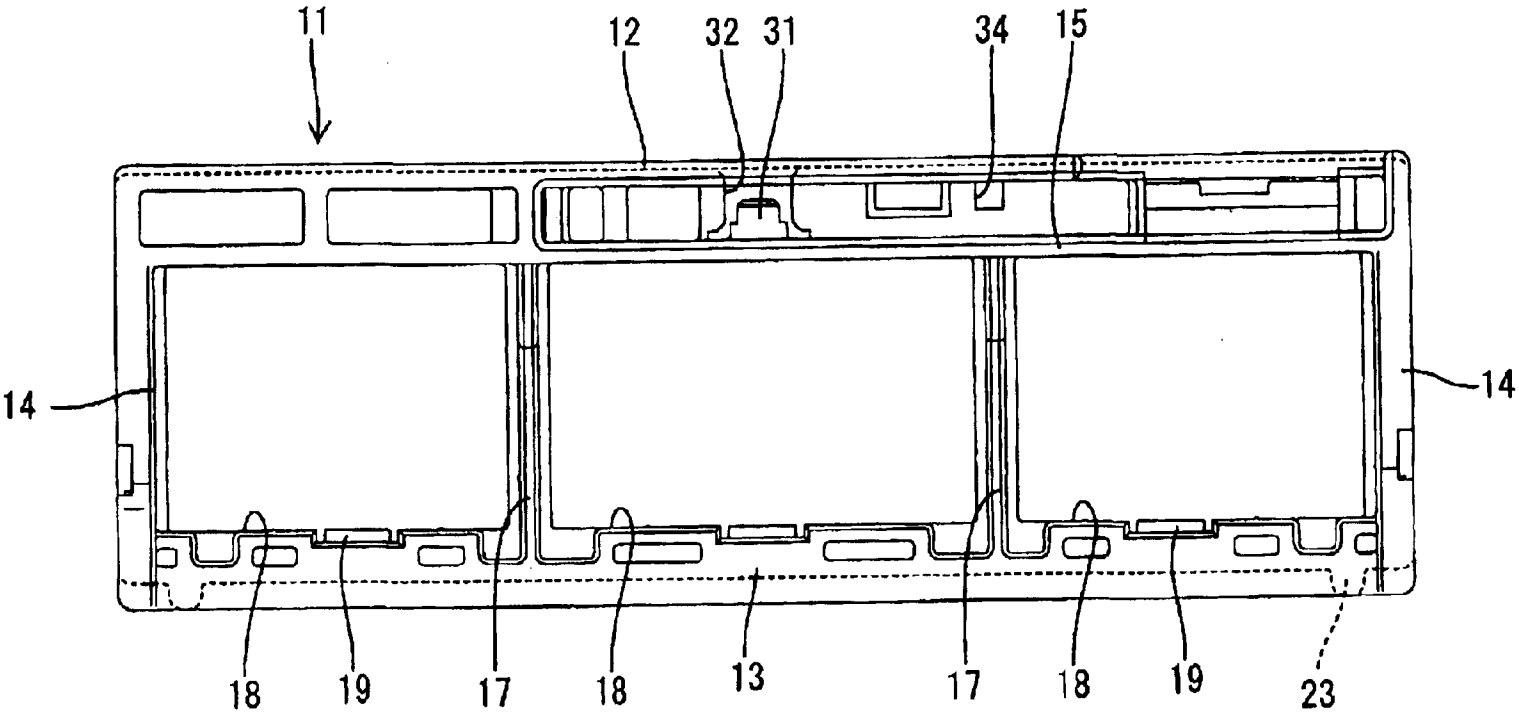
FIG. 2 is a rear view of a holder.
Figure 3:
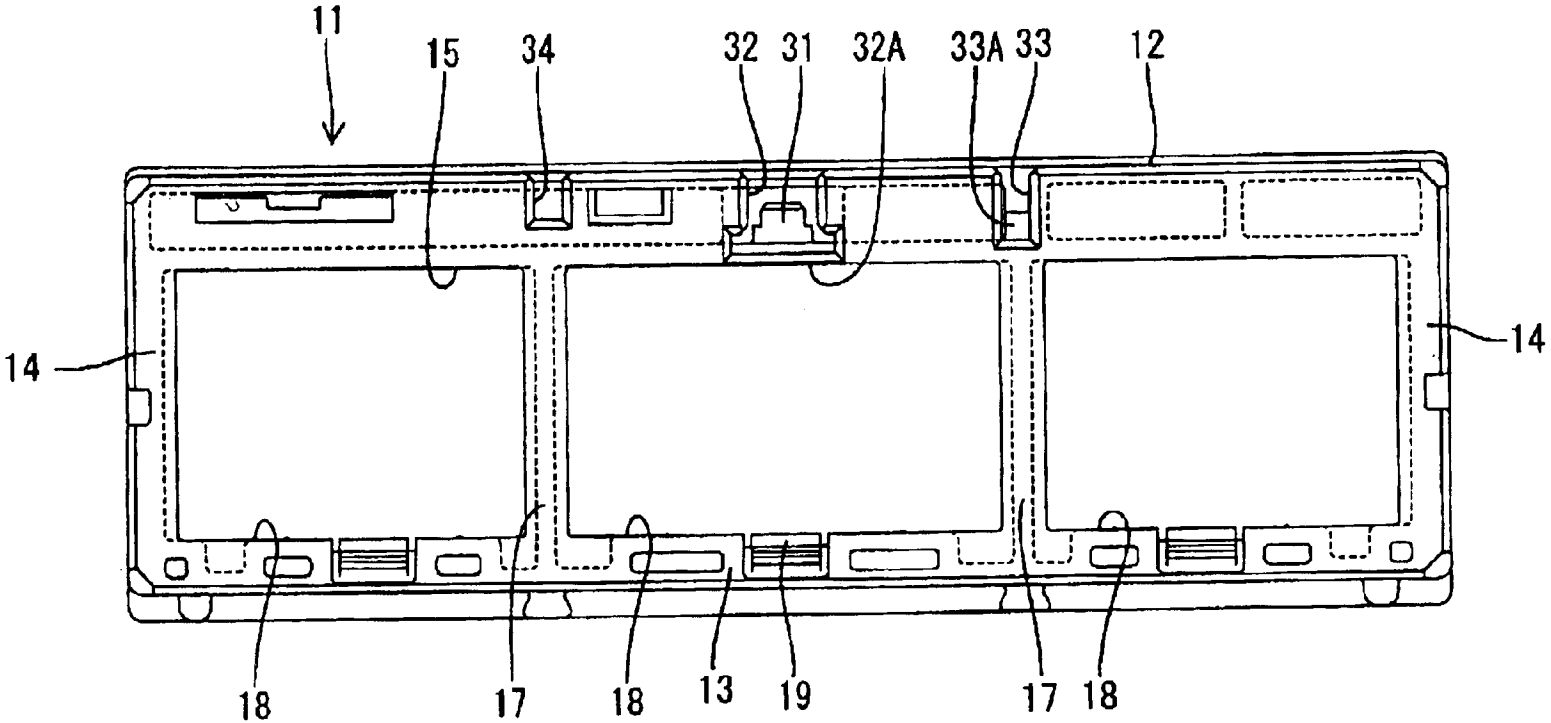
FIG. 3 is front view of the holder.

The female connector 10 is a divided connector and includes a frame-shaped holder 11 that accommodates auxiliary connectors 27. The holder 11 is made e.g. of a synthetic resin and, as shown in FIGS. 1 to 3, is a wide box that is hollow in forward and backward directions. Specifically, the holder 11 has an upper wall 12, a bottom wall 13 and left and right side walls 14. A ceiling wall 15 extends substantially parallel to the upper wall 12 and an accommodating recess 16 is defined between the upper wall 12 and the ceiling wall 15 for accommodating a lever 40. An area below the accommodating recess 16 is divided into three accommodating chambers 18 arranged substantially side-by-side and the partitioning walls 17 extend between the ceiling wall 15 and the bottom wall 13. The auxiliary connectors 27 are fittable into the accommodating chambers 18 from an auxiliary connector insertion side. Resiliently deformable locks 19 are formed in the bottom wall 13 of the holder 11 substantially in conformity with the respective accommodating chambers 18. The bottom wall 13 of the holder 11 also is formed with a wide recess 21 that extends along the transverse direction of the holder 11, and a retainer 22 is fittable into the recess 21 from below. Four rows of guide ribs 23 are formed on the bottom wall 13 and extend substantially along forward and backward directions FBD. Each row is divided into a pair of guide ribs 23 located at the opposite sides of the recess 21.

Each auxiliary connector 27 is made e.g. of a synthetic resin and has a substantially rectangular block shape (see FIG. 1). Cavities 28 extend through the auxiliary connector 27 for receiving the female terminal fittings 29 from a terminal insertion side. Each auxiliary connector 27 is into the corresponding accommodating chamber 18 of the holder 11 from behind, and is held so as not to come out by the lock 19 and by the retainer 22 fit into the recess 21.

Figure 5:
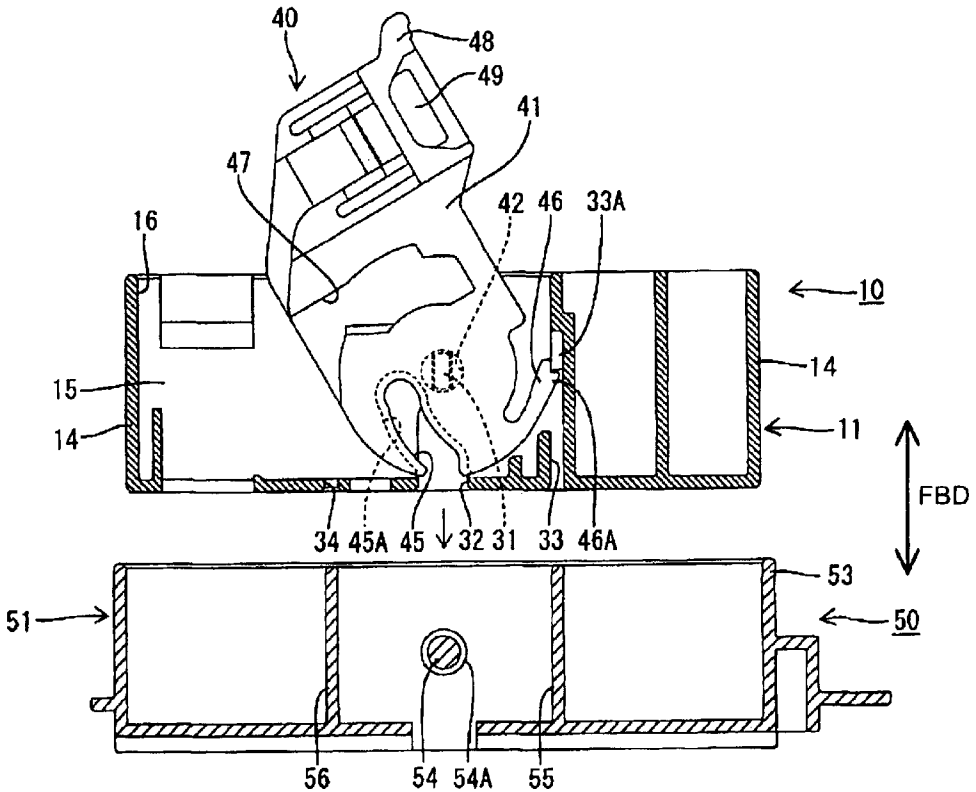
FIG. 5 is a horizontal section showing the state before the female and male connectors are connected.

The lever 40 is made e.g. of a synthetic resin and is in the form of a single slightly narrow cam plate 41, as shown in FIGS. 1 and 5. The inwardly oriented surface of the cam plate 41 is recessed to form a substantially round bearing hole 42 near one end of the cam plate 41. The cam plate 41 is accommodated in the accommodating recess 16 while defining a small clearance to the upper surface 12 and the ceiling wall 15. The bearing hole 42 is to be engaged with a supporting shaft 31 that projects up from the ceiling wall 15 in the accommodating recess 16 of the holder 11 substantially normal to the forward and backward direction FBD. The lever 40 is substantially horizontally rotatable about the supporting shaft 31.

Figure 6:
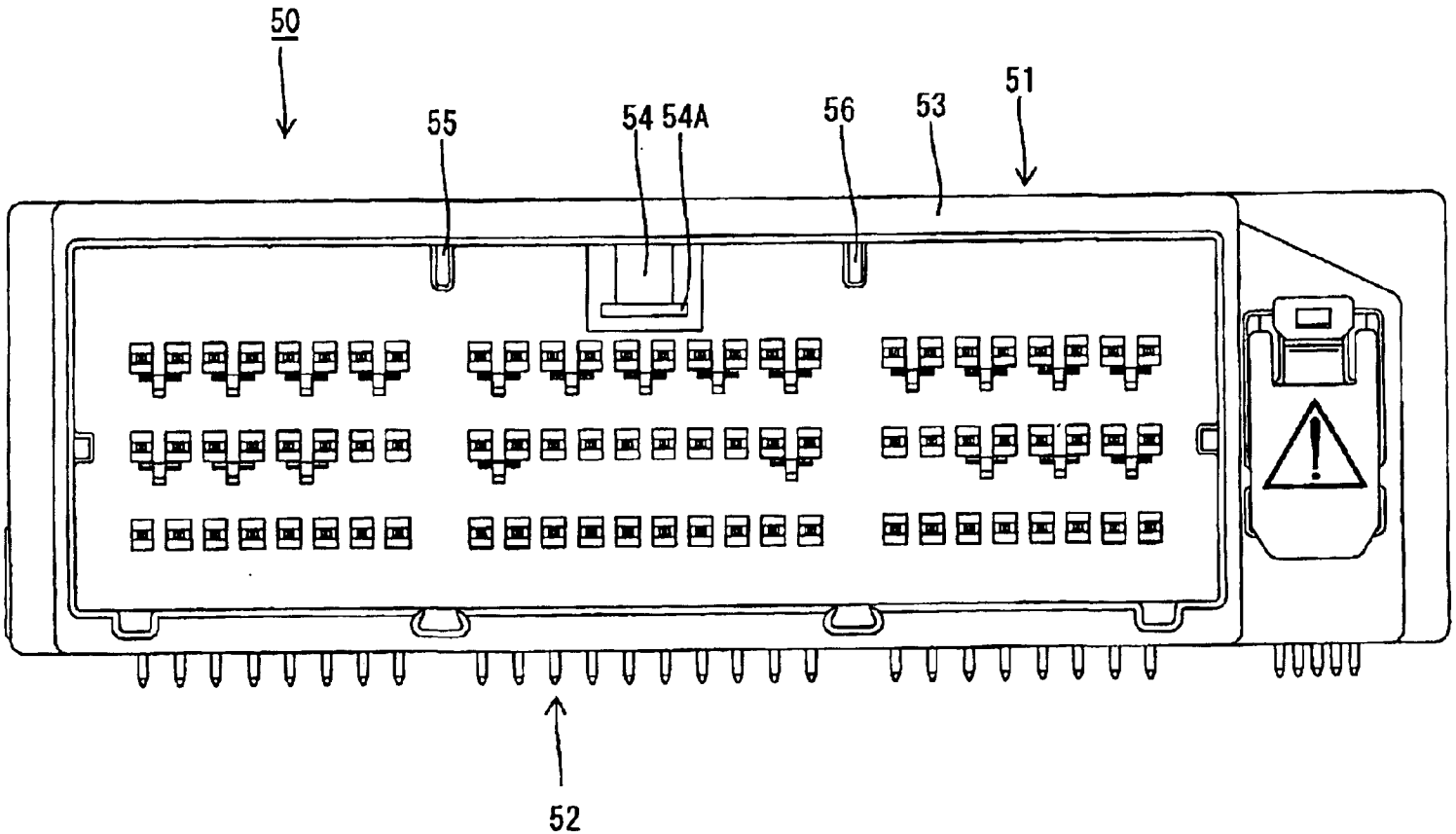
FIG. 6 is a front view of the male connector.

The male connector 50 is comprised of a housing 51 made e.g. of a synthetic resin and male terminal fittings 52, as shown in FIGS. 1 and 6. The housing 51 has a rectangular tubular receptacle 53 with an open front end, and the holder 11 of the female connector 10 is fit closely into the receptacle 53. The male terminal fittings 52 project from the back end surface of the receptacle 53 and are connected with the corresponding female terminal fittings 29 when the two connectors 10, 50 are connected properly. A cylindrical cam pin 54 projects down substantially in the middle of the ceiling surface in a direction intersecting the plane containing the cam plate 41 and a round jaw 54A bulges radially out at the leading end of the cam pin 54. An unlocking rib 55 extends from the front end of the receptacle 53 to the rear end thereof. The unlocking rib 55 projects from a position on the ceiling surface of the receptacle 53 slightly toward the left side from the middle when viewed from front. An insertion preventing rib 56 extends back from the front end of the receptacle 53 and projects from the ceiling surface of the receptacle 53 at a position slightly toward the right side from the middle when viewed from front and hence at a side substantially symmetrically opposite the unlocking rib 55. The ribs 55, 56 divide the receptacle 53 into three sections along longitudinal direction. A space between the two ribs 55 and 56 is slightly shorter than a dimension of the holder 11 along forward and backward directions FBD.

Figure 4:
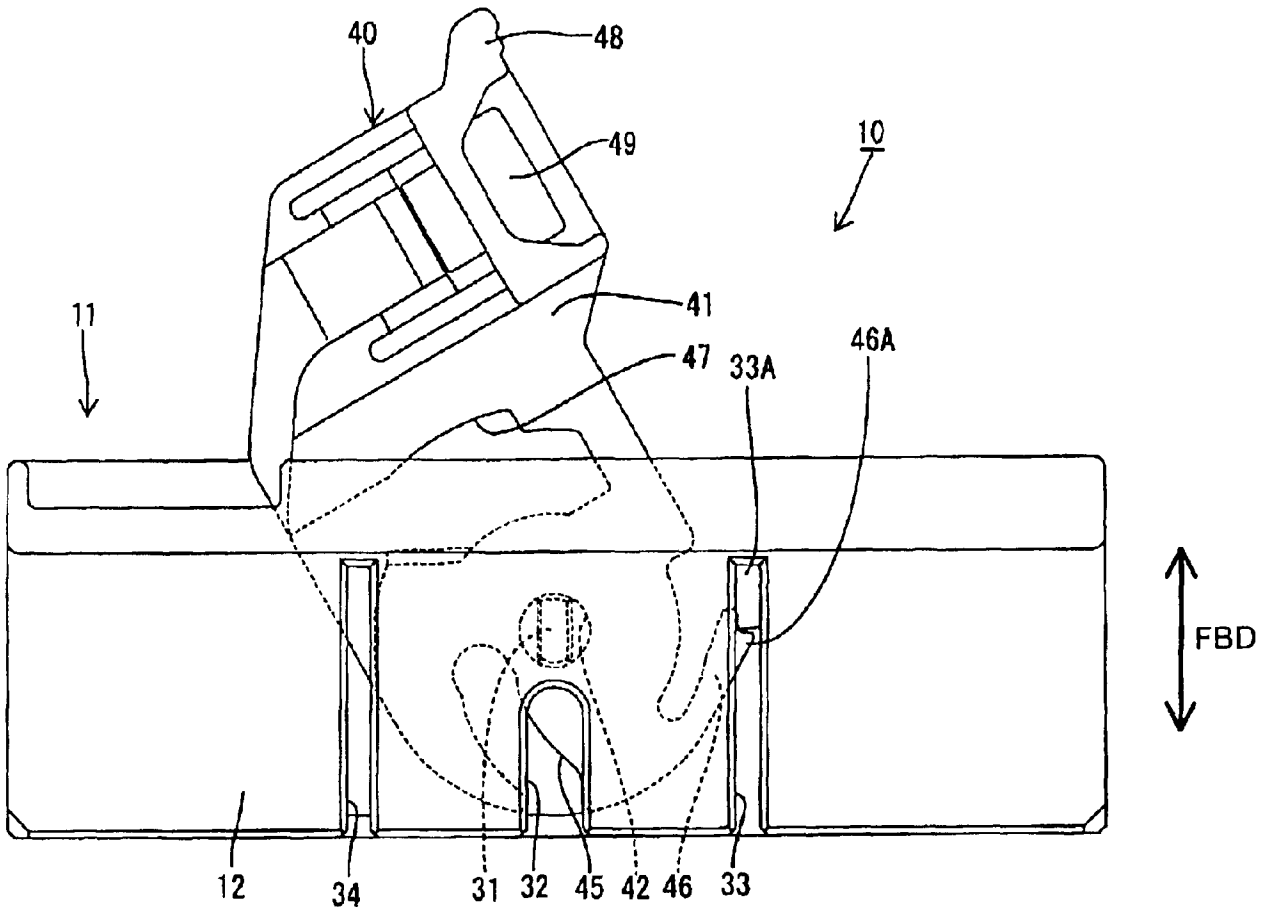
FIG. 4 is a plan view of the female connector.

A cam-pin insertion groove 32 is formed in the upper wall 12 of the holder 11 and the upper surface of the ceiling wall 15, as shown in FIGS. 3 and 4. The cam pin insertion groove 32 has open front ends for receiving the cam pin 54. The ceiling wall 15 includes a partition wall 32A between the cam-pin insertion groove 32 and the accommodating chamber 18 therebelow. Thus, the holder 11 is stronger than a holder 11 in which a cam-pin insertion groove communicates with an accommodating chamber. Rib insertion grooves 33, 34 are formed in the upper wall 12 of the holder 11 at the left and right sides of the cam-pin insertion groove 32. The rib insertion grooves 33, 34 extend in forward and backward directions FBD for receiving the unlocking rib 55 and the insertion preventing rib 56.

Figure 7:
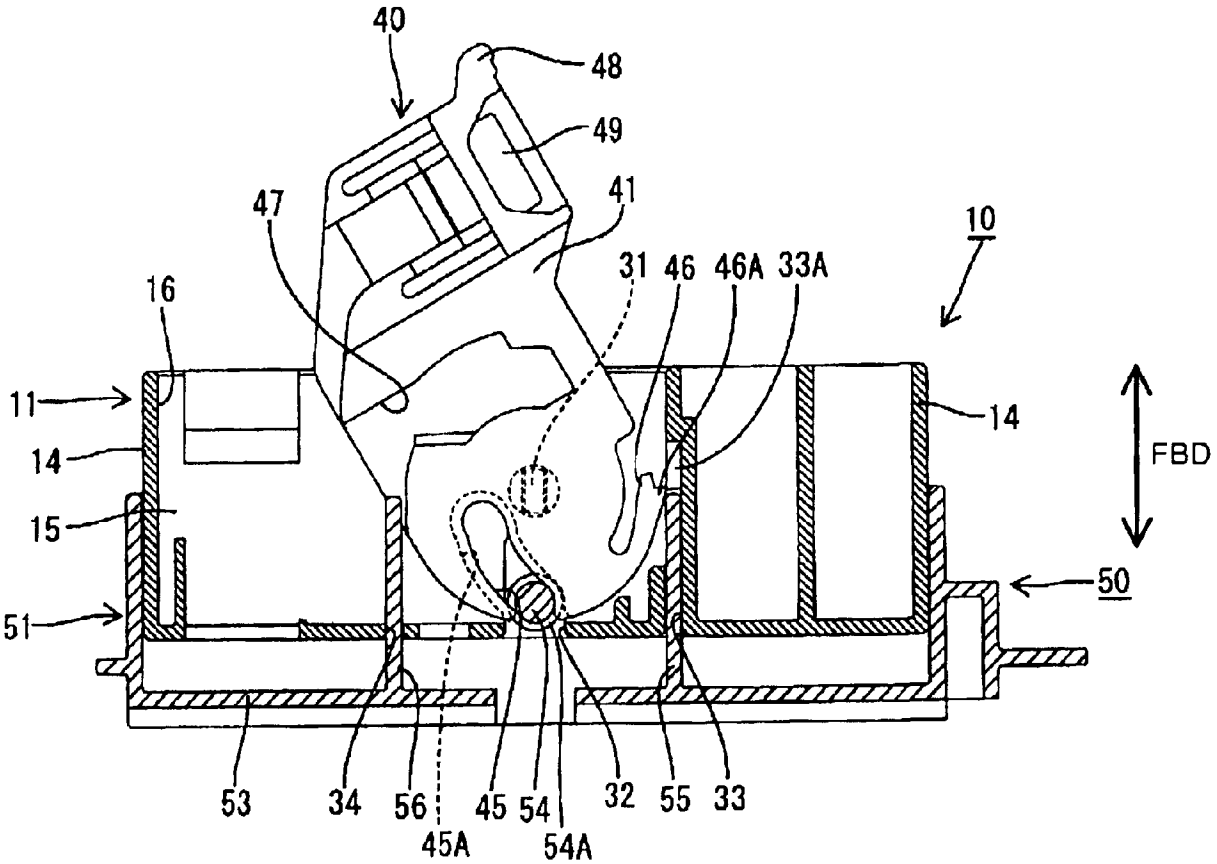
FIG. 7 is a horizontal section showing an initial stage of the connection of the female and male connectors.
Figure 8:
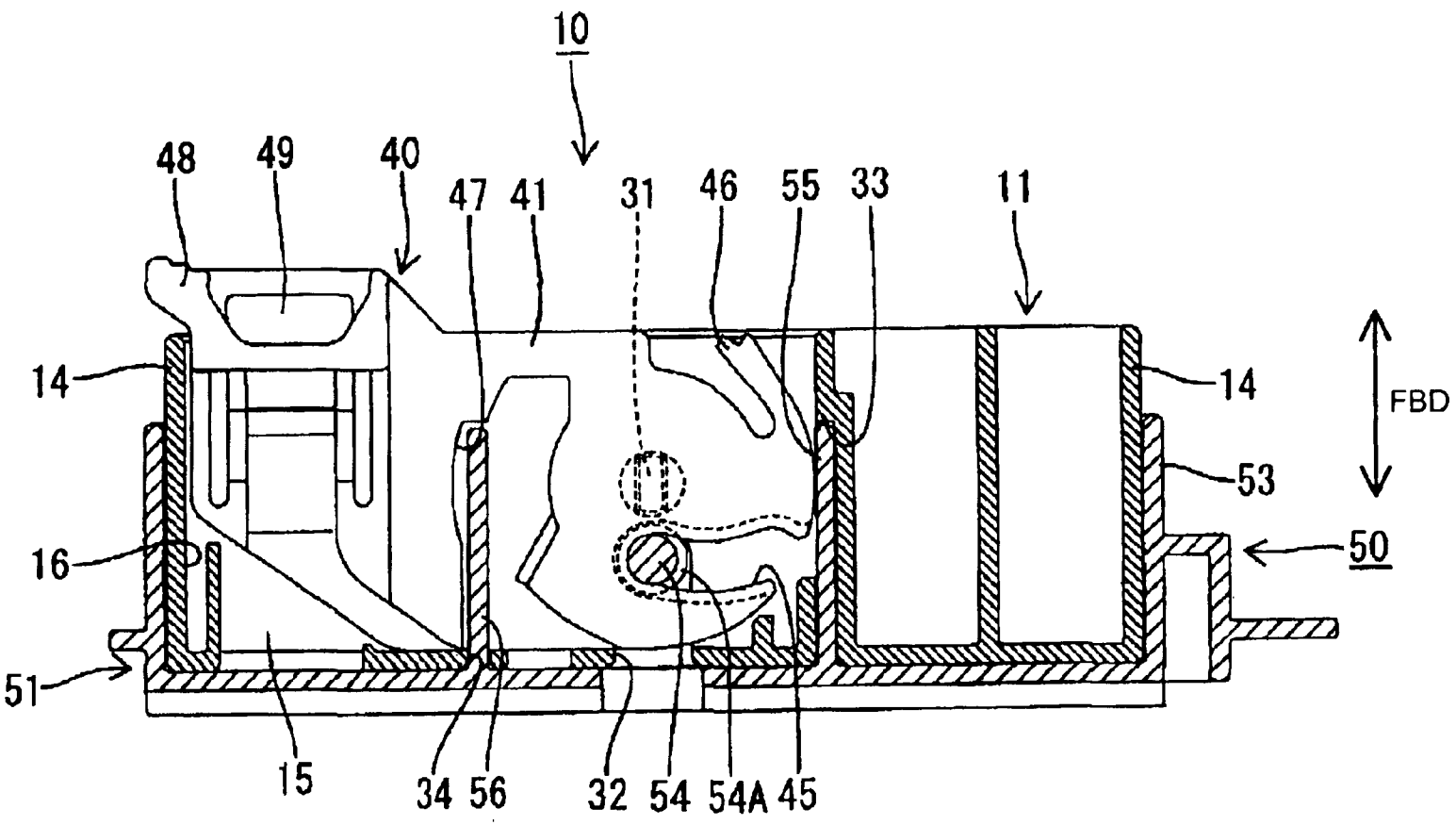
FIG. 8 is a horizontal section showing a state where the connection of the female and male connectors is completed.
Figure 9:
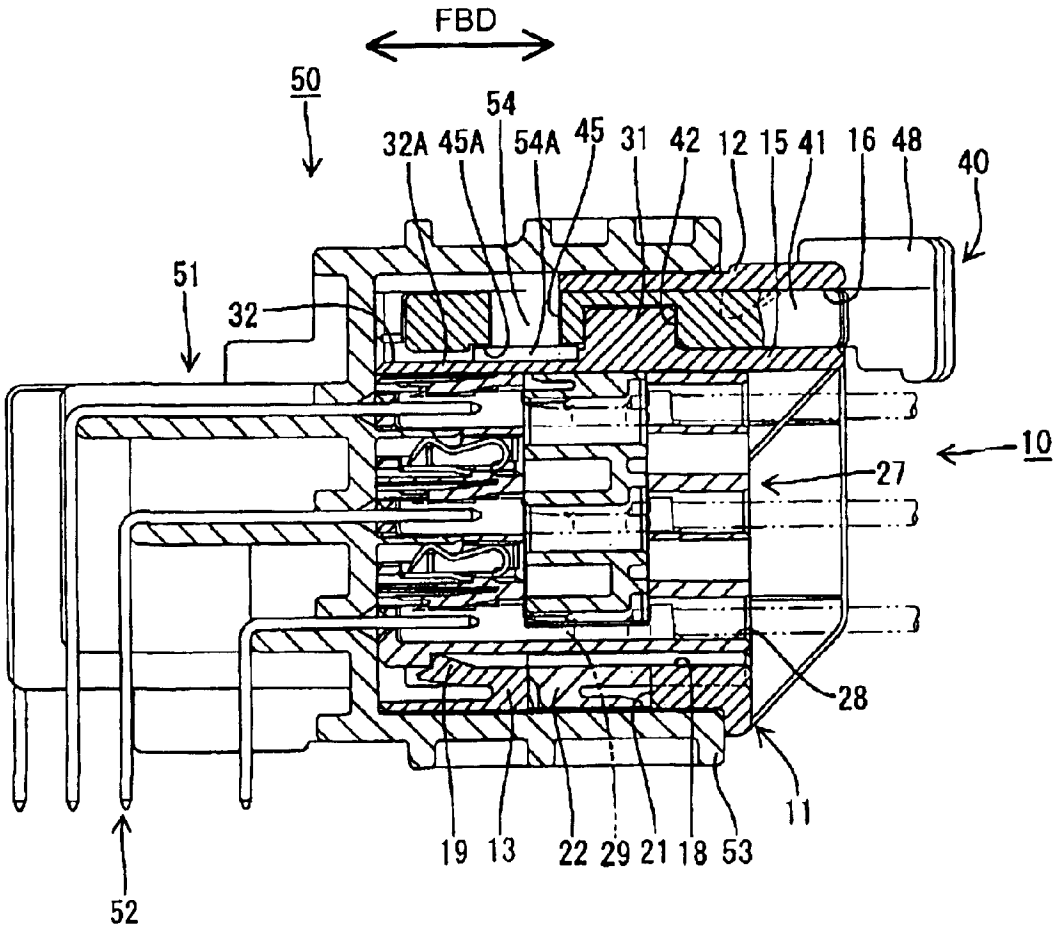
FIG. 9 is a longitudinal section showing the state where the connection of the female and male connectors is completed.
Figure 10A:
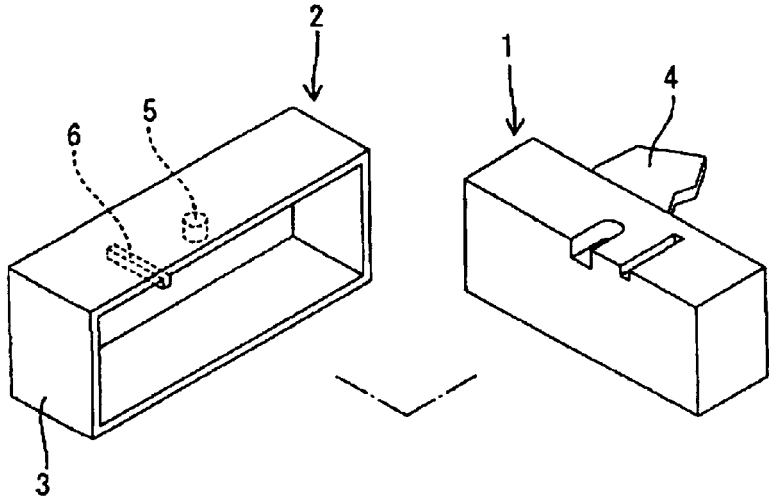
FIG. 10(A) PRIOR ART
FIG. 10(A) is an exploded perspective view of a prior art connector.
Figure 10B:
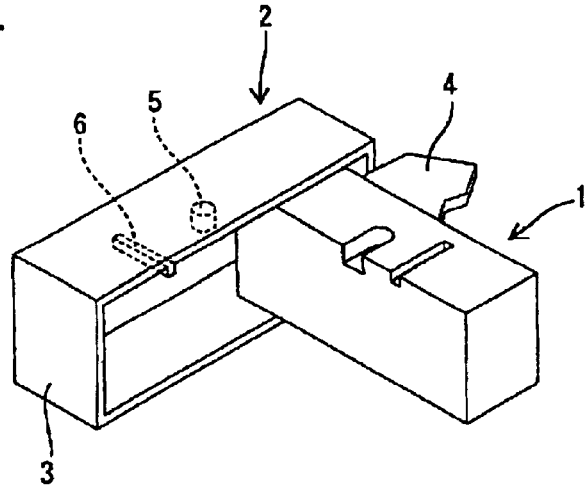
FIG. 10(B) PRIOR ART
FIG. 10(B) is a perspective view showing a state where one housing of the prior art connector is fitted into a receptacle of a mating housing in a wrong posture.
Figure 11:
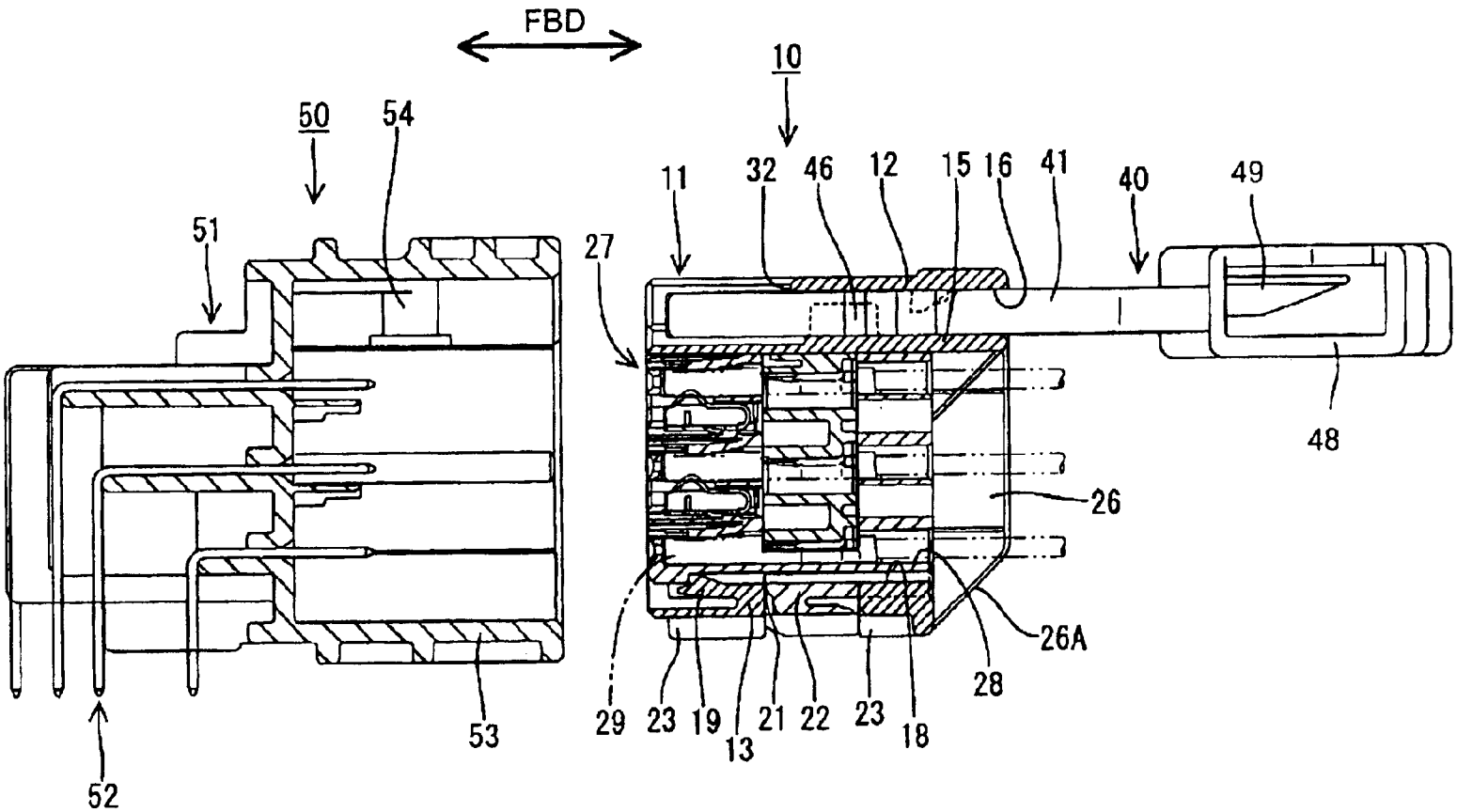
FIG. 11 is a longitudinal section showing a state of a female connector and a male connector according to one further preferred embodiment of the invention before being connected.
Figure 12:
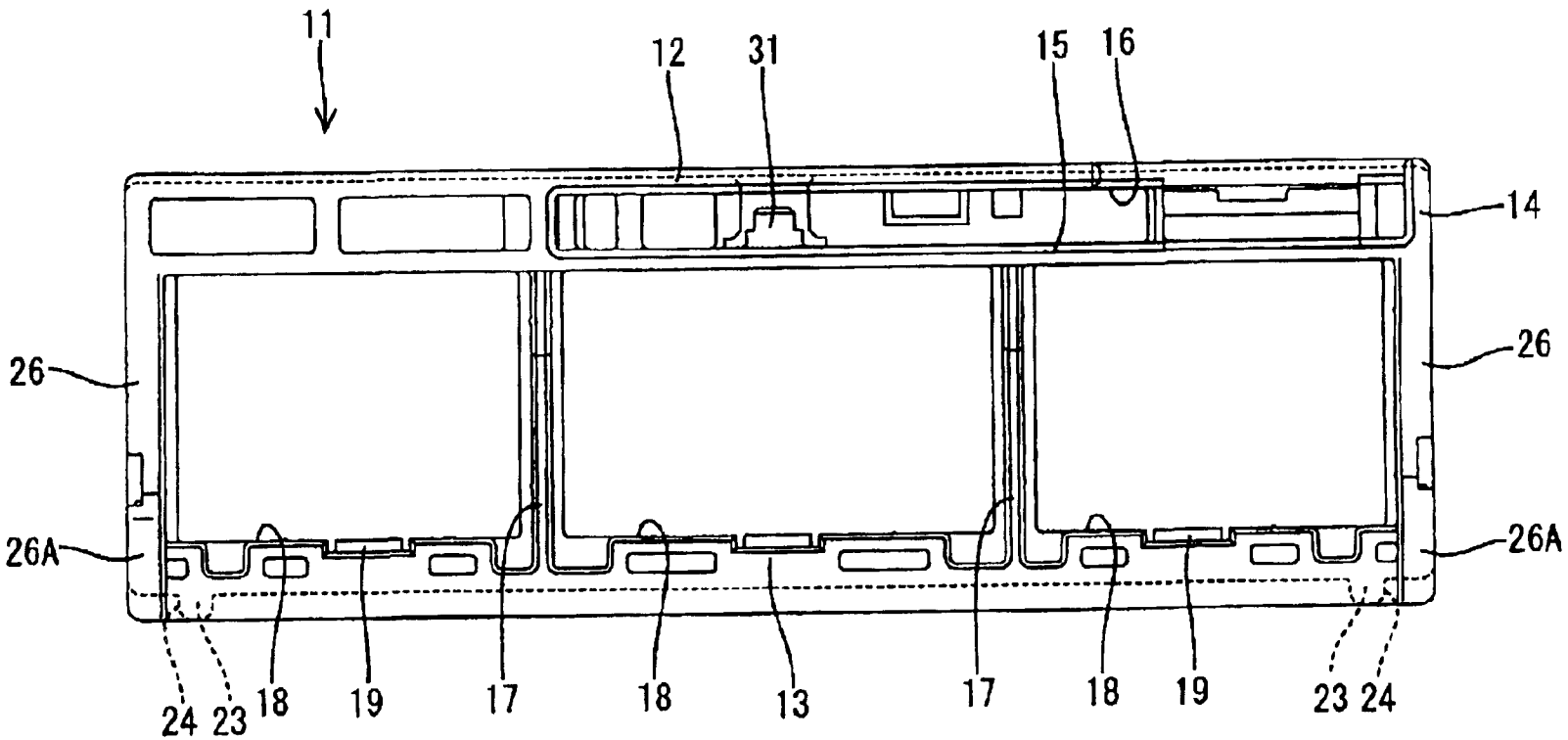
FIG. 12 is rear view of a holder.
Figure 13:
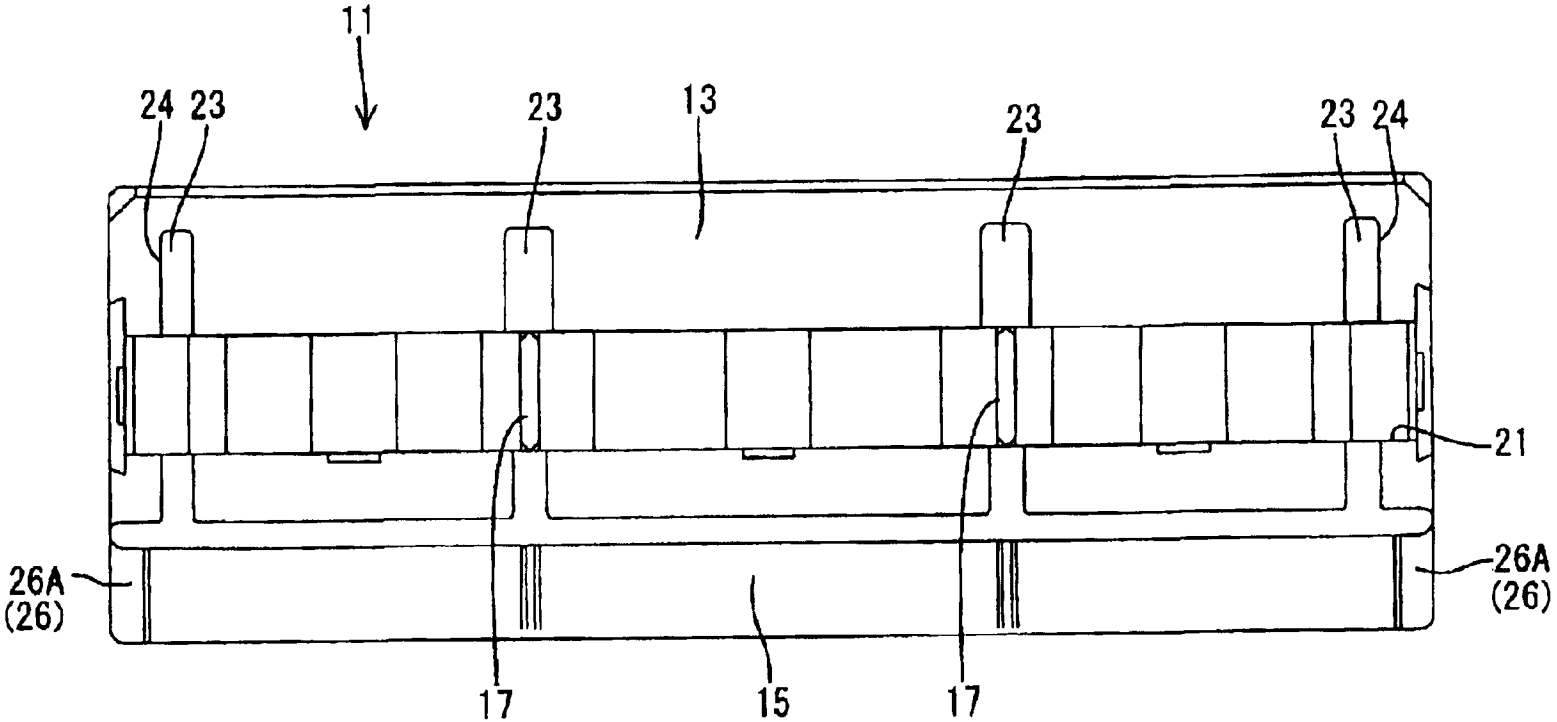
FIG. 13 is a bottom view of the holder.
Figure 14:
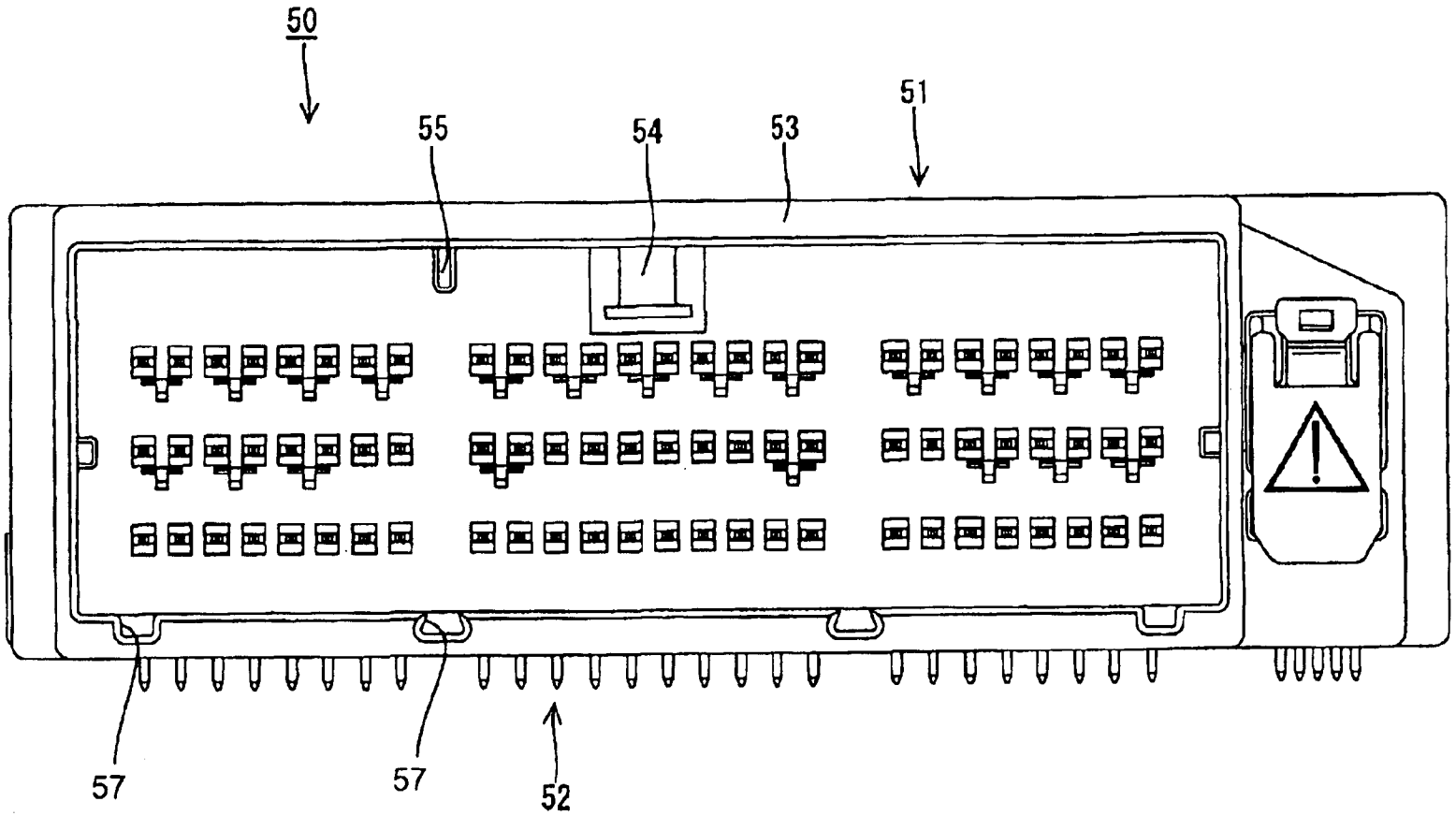
FIG. 14 is a front view of the male connector.
Figure 15:
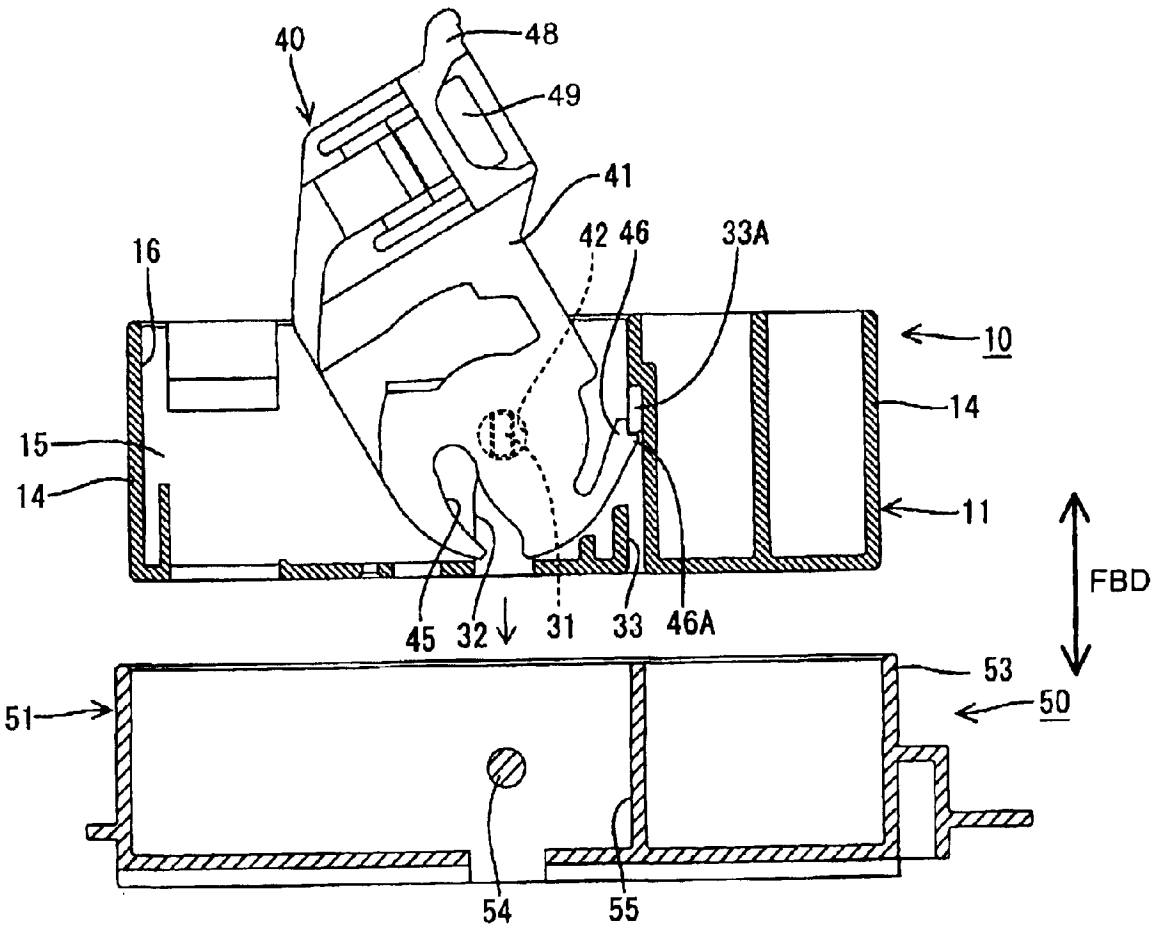
FIG. 15 is a horizontal section showing the state of the female connector and the male connector before being connected.
Figure 16:
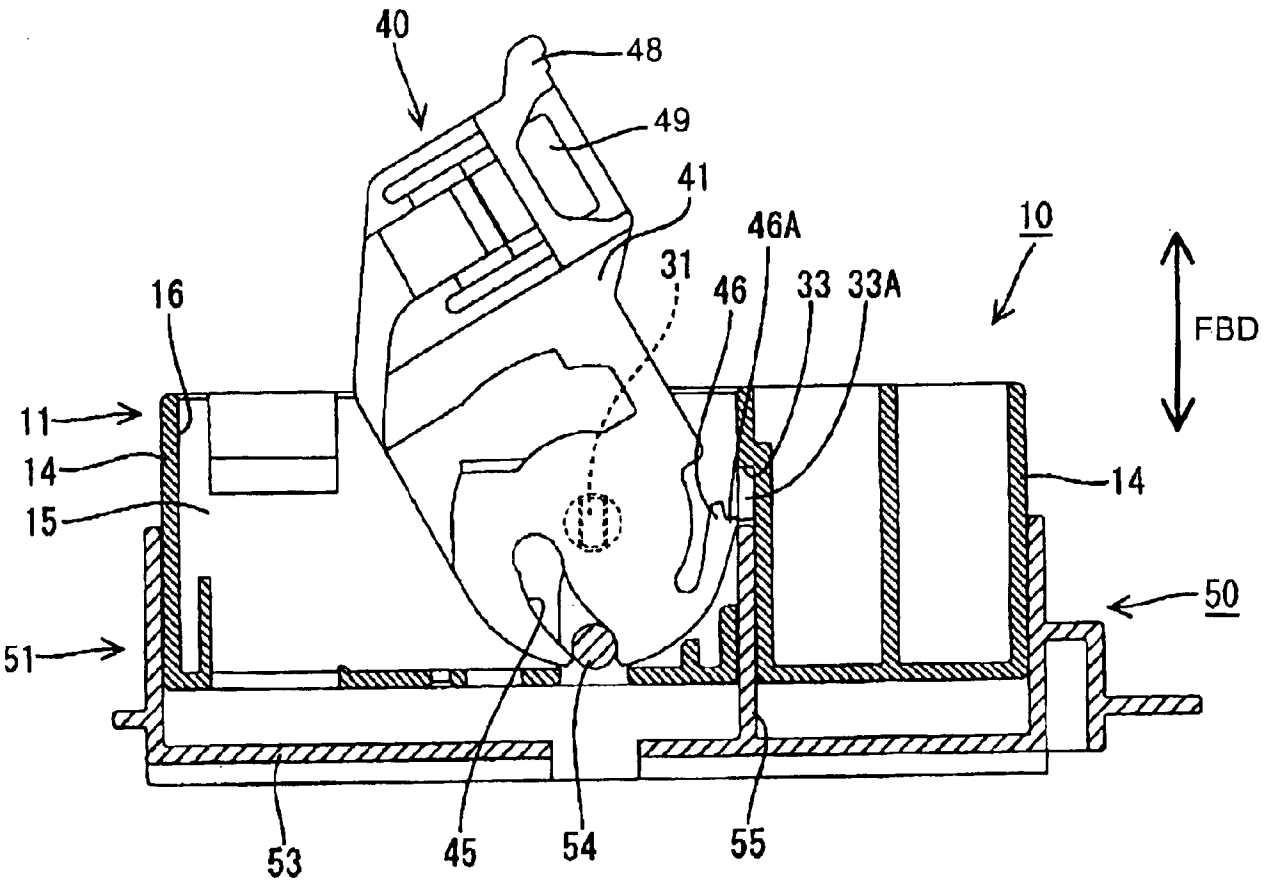
FIG. 16 is a horizontal section showing an initial stage of the connection of the female connector and the male connector.
Figure 17:
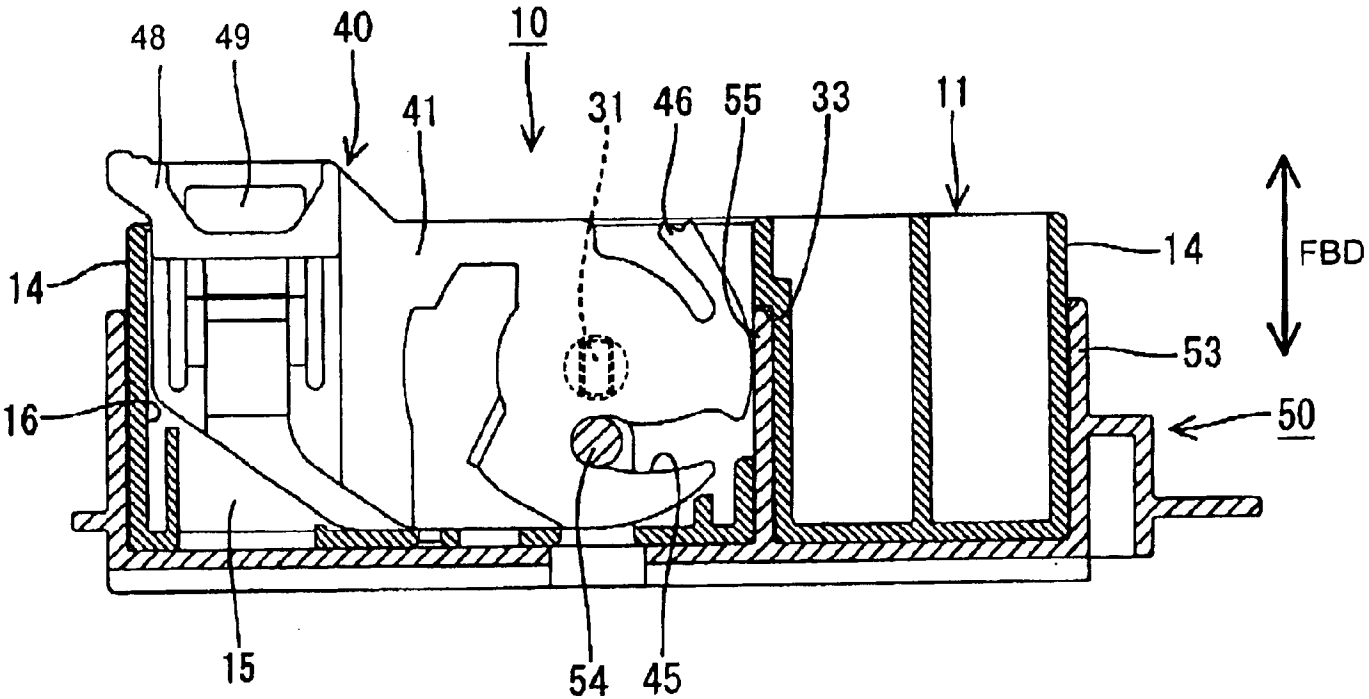
FIG. 17 is a horizontal section showing a state where the connection of the female connector and the male connector is completed.
Figure 18:
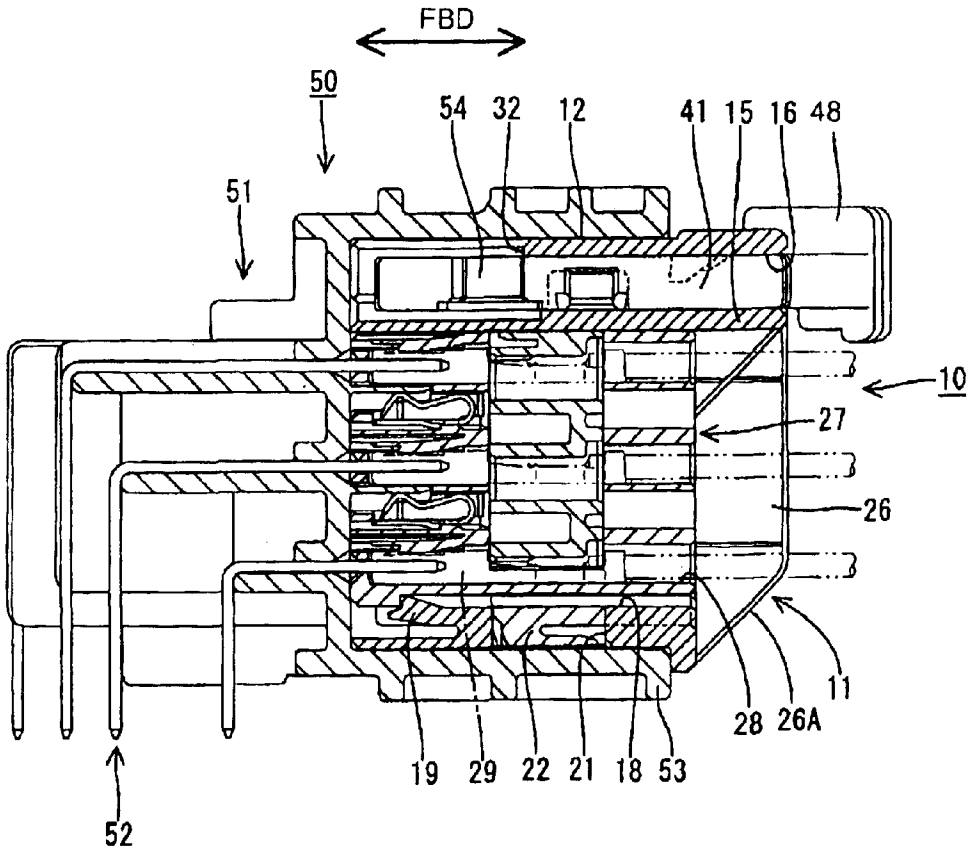
FIG. 18 is a longitudinal section showing a state where the connection of the female connector and the male connector is completed.

A cam groove 45 is formed in the cam plate 41 of the lever 40 and extends around the bearing hole 42 as shown in FIGS. 4, 5, 7 and 8 for receiving the cam pin 54 of the male connector 50. A step 45A is formed at the lower edge of the cam groove 45 and is engageable with the jaw 54A of the cam pin 54. The lever 40 is rotatable from an initial position (FIG. 5) to a connection ending position (FIG. 8). The entrance of the cam groove 45 aligns with the cam-pin insertion groove 32 when the lever 40 is at the initial position, thereby enabling the cam pin 54 to enter the cam groove 45.

A resilient locking piece 46 is cantilevered at an end of the cam plate 41 near the bearing hole 42. The resilient locking piece 46 is deformable in a direction substantially normal to the axis of rotation of the lever 40 towards and away from the supporting shaft 31. An outward-projecting projection 46A is formed at the leading end of the resilient locking piece 46. An engaging portion 33A projects in a lower-half of the rear end of the rib insertion groove 33 of the holder 11. The projection 46A of the resilient locking piece 46 enters the rib insertion groove 33 and a lower part of the projection 46A engages the engaging portion 33A when the lever 40 is at the initial position. Thus, rotation of the lever 40 toward the connection ending position is prevented.

An escape groove 47 is formed in the longitudinal middle of the upper surface of the cam plate 41 for receiving the insertion preventing rib 56.

An operable portion 48 and a resilient locking piece 49 are formed at an end of the cam plate 41 substantially opposite the bearing hole 42. The resilient locking piece 49 locks the lever 40 at the connection ending position.

The lever 40 initially is locked at the initial position in the holder 11, as shown in FIG. 5, and the holder 11 of the female connector 10 is fit lightly into the receptacle 53 of the male connector 50. At this time, the female connector 10 could mistakenly be fit upside down into the receptacle 53. However, the leading ends of the unlocking rib 55 and the insertion preventing rib 56 will contact the holder 11 to prevent insertion. The female housing 10 also could be pushed into the receptacle 53 from the front while held in a lateral posture (including an oblique posture). However, the sidewall 14 of the holder 11 will contact the unlocking rib 55 or the insertion preventing rib 56, and will prevent insertion of the holder 11.

The cam pin 54 enters the cam groove 45 and the unlocking rib 55 contacts the projection 46A of the resilient locking piece 46 when the holder 11 is fit lightly into the receptacle 53 in a proper posture. Thus, the resilient locking piece 46 deforms resiliently and disengages from the engaging portion 33A, as shown in FIG. 7. As a result, the lever 40 is permitted to rotate.

The operable portion 48 of the lever 40 is pushed to rotate the lever 40 toward the connection ending position. As a result, a cam action between the cam pin 54 and the cam groove 45 pulls the connectors 10, 50 together, and the holder 11 moves further into the receptacle 53. The jaw 54A of the cam pin 54 engages the step 45A of the cam groove 45. Accordingly, the cam plate 41 and the holder 11 cannot deform and displace vertically in response to stresses created during the operation. Consequently, the lever 40 reaches the connection ending position and the resilient locking piece 49 engages the male housing 51 to lock the lever 40. In this way, the connectors 10, 50 reach their properly connected state (see FIGS. 8 and 9) to complete the connection.

As described above, the insertion preventing rib 56 is on the inner surface of the receptacle 53 opposite the unlocking rib 55, and prevents the female connector 10 from being fit in a wrong posture into the side of the receptacle 53 where the unlocking rib 55 is not provided. Thus, the female connector 10 cannot contact and deform the male terminal fittings 52.

Further, the rib insertion groove 34 for receiving the insertion-preventing groove 56 is formed in the outer wall of the frame-shaped holder 11 for accommodating a plurality of auxiliary connectors 27. Thus, the divided connector cannot fit into the receptacle 53 in a wrong orientation.

A second embodiment is described with reference to FIGS. 11 to 21, wherein elements similar to those in the first embodiment have the same reference numeral and a repetitive description is omitted.

Four rows of guide ribs 23 are formed on the bottom wall 13 and extend along forward and backward directions FBD.

Each row is divided into a pair of guide ribs 23 located at opposite sides of the recess 21. The outer two rows of guide ribs 23 are spaced slightly away from sidewalls 14, and step-shaped catches 24 are formed at the left and right sides of the bottom wall 13. The front ends of the respective walls 12, 13, 14, 15, 17 of the holder 11 are substantially aligned. However, the rear ends of the upper and ceiling walls 12, 15 project back by a specified distance from the rear ends of the bottom wall 13 and the partition walls 17. Further, the rear ends of the left and right walls 14 project back by substantially the same distance as the upper and ceiling walls 12, 15 to define insertion-preventing walls 26. A slanted surface 26A is formed at the bottom end of each insertion-preventing wall 26.

The bottom wall 13, the partition walls 17 and auxiliary connectors 27 each have a depth along forward and backward directions FBD that is slightly smaller than an inner dimension of the receptacle 53 along the height direction, which is substantially normal to the forward and backward direction FBD. On the other hand, the upper wall 12, the ceiling wall 15 and the sidewalls 14 (insertion preventing walls 26) each have a depth that exceeds the inner height of the receptacle 53.

Figure 19:
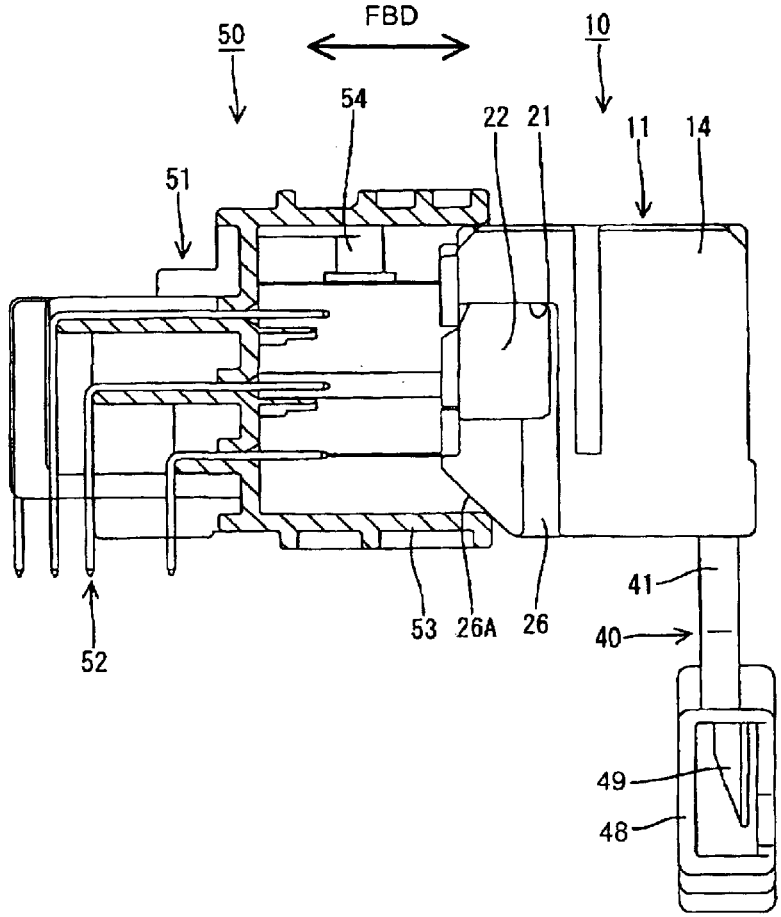
FIG. 19 is a longitudinal section showing a state where the insertion of the female connector into a receptacle is prevented by an insertion preventing wall.
Figure 20:
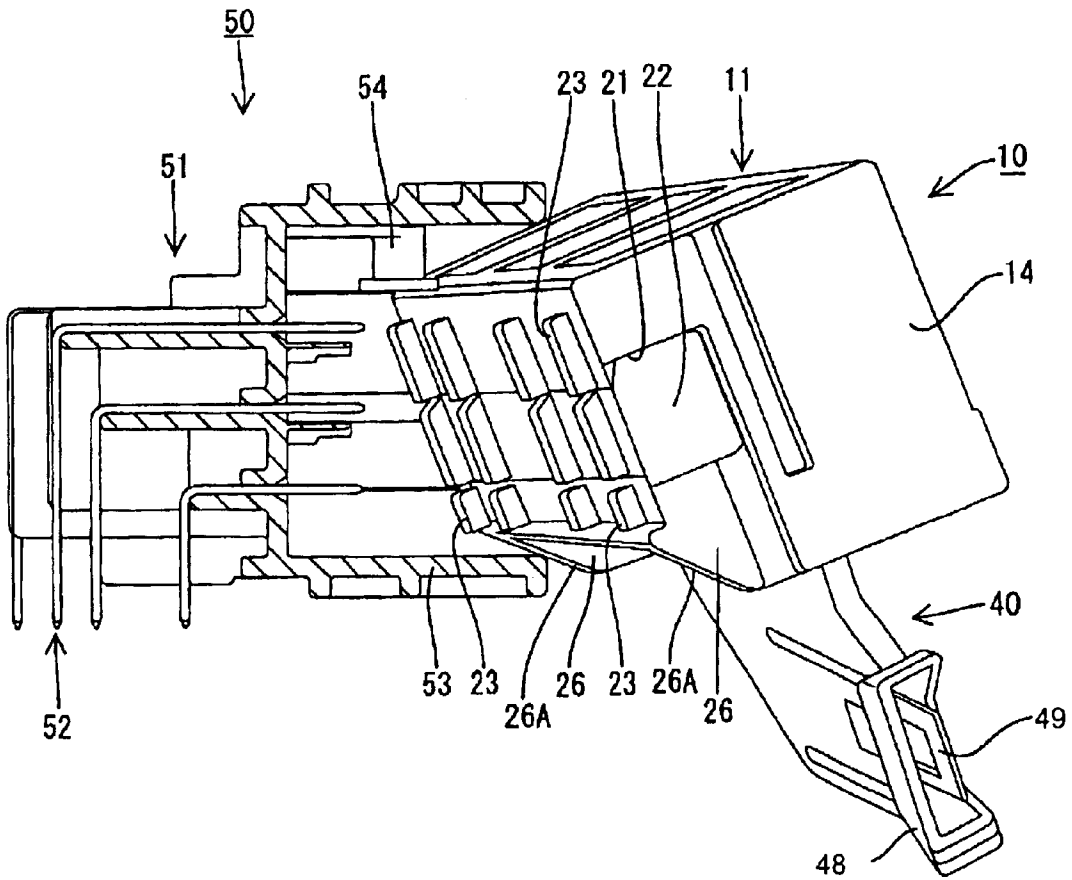
FIG. 20 is a longitudinal section showing another state where the insertion of the female connector into a receptacle is prevented by the insertion preventing wall.
Figure 21:
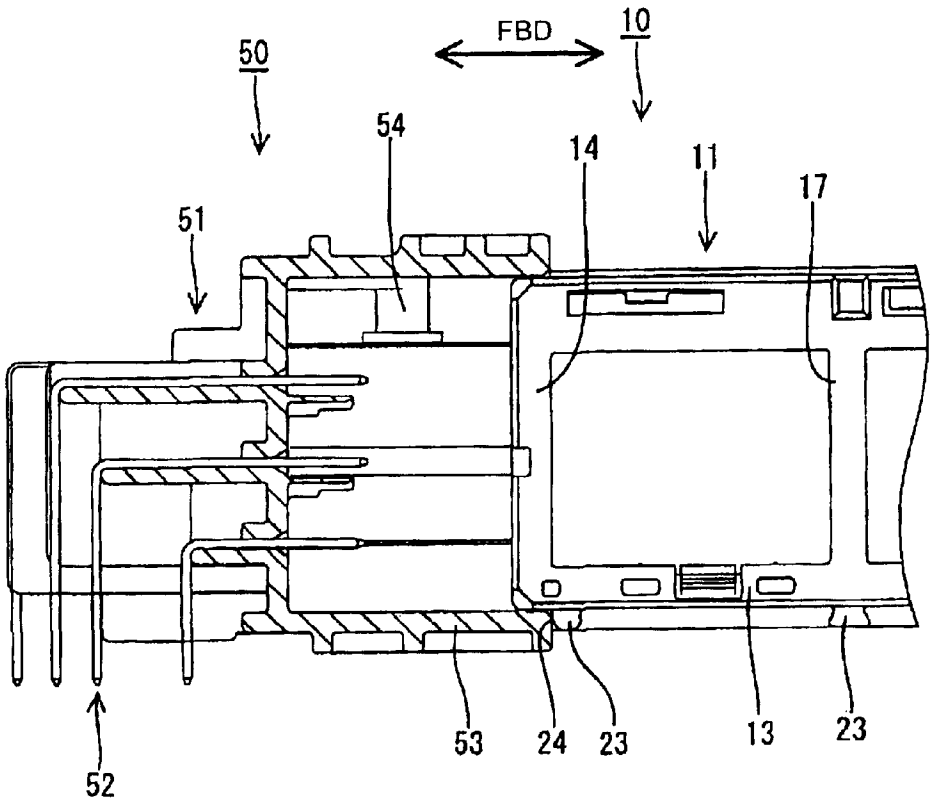
FIG. 21 is a longitudinal section showing a state where the insertion of the female connector into the receptacle is prevented by a catch.
Figure 22:
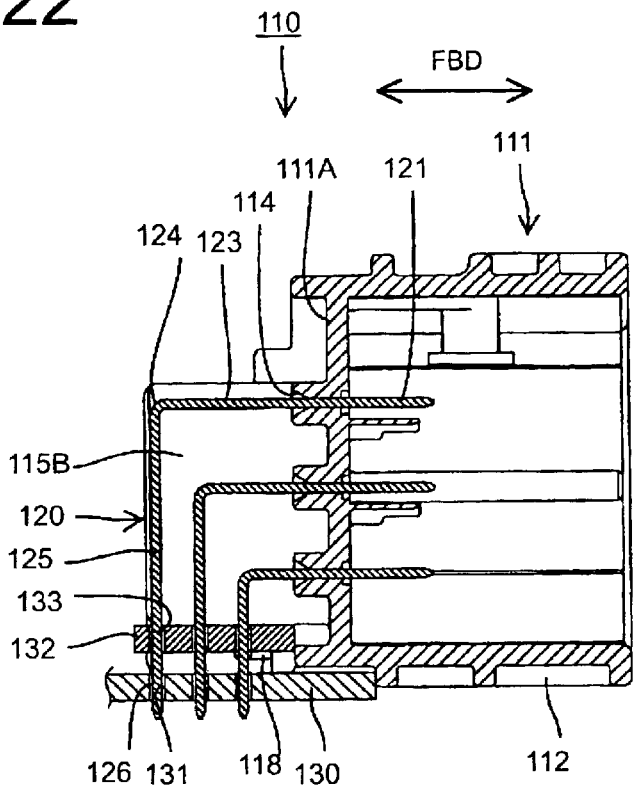
FIG. 22 is a longitudinal section of a circuit board connector according to a preferred embodiment.
Figure 23:
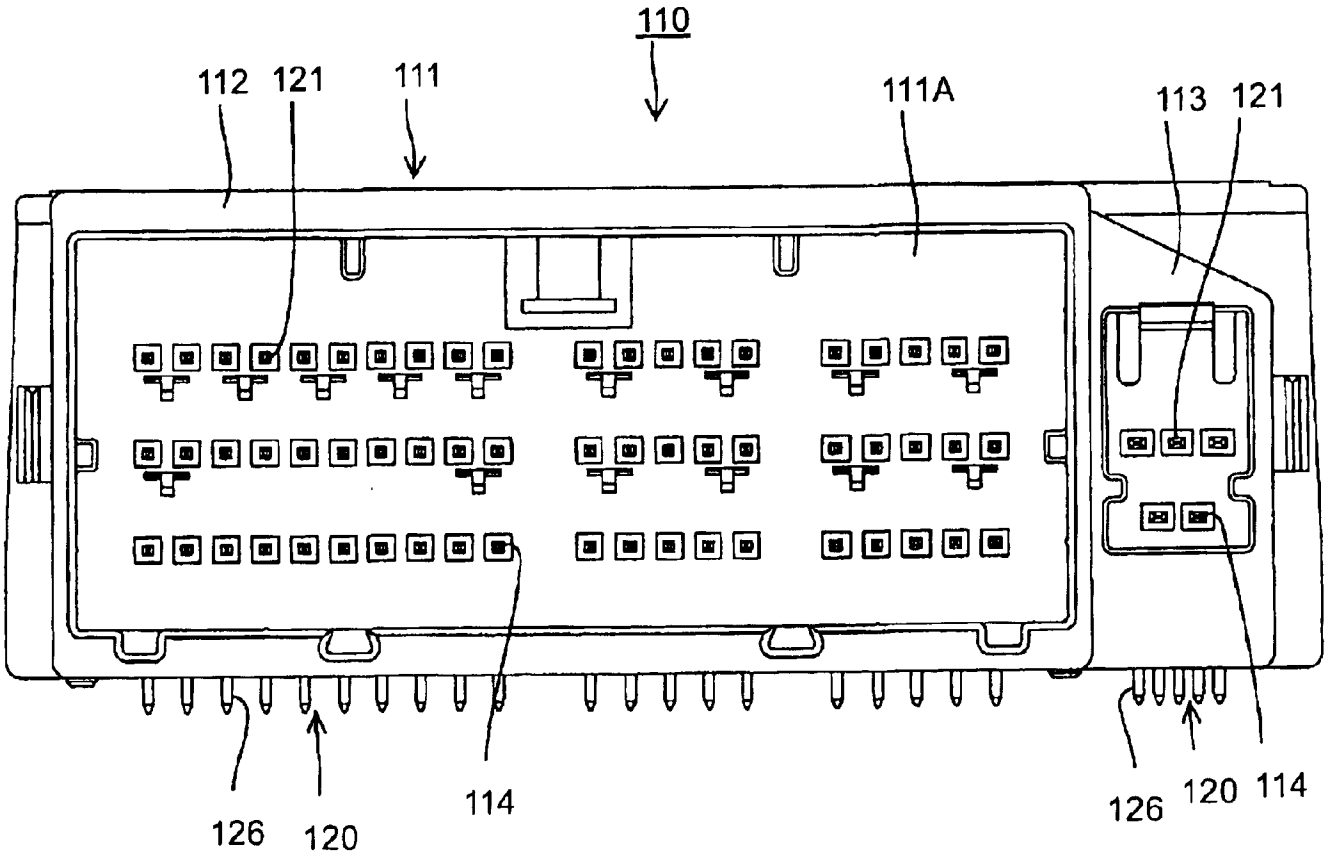
FIG. 23 is a front view of the circuit board connector.
Figure 24:
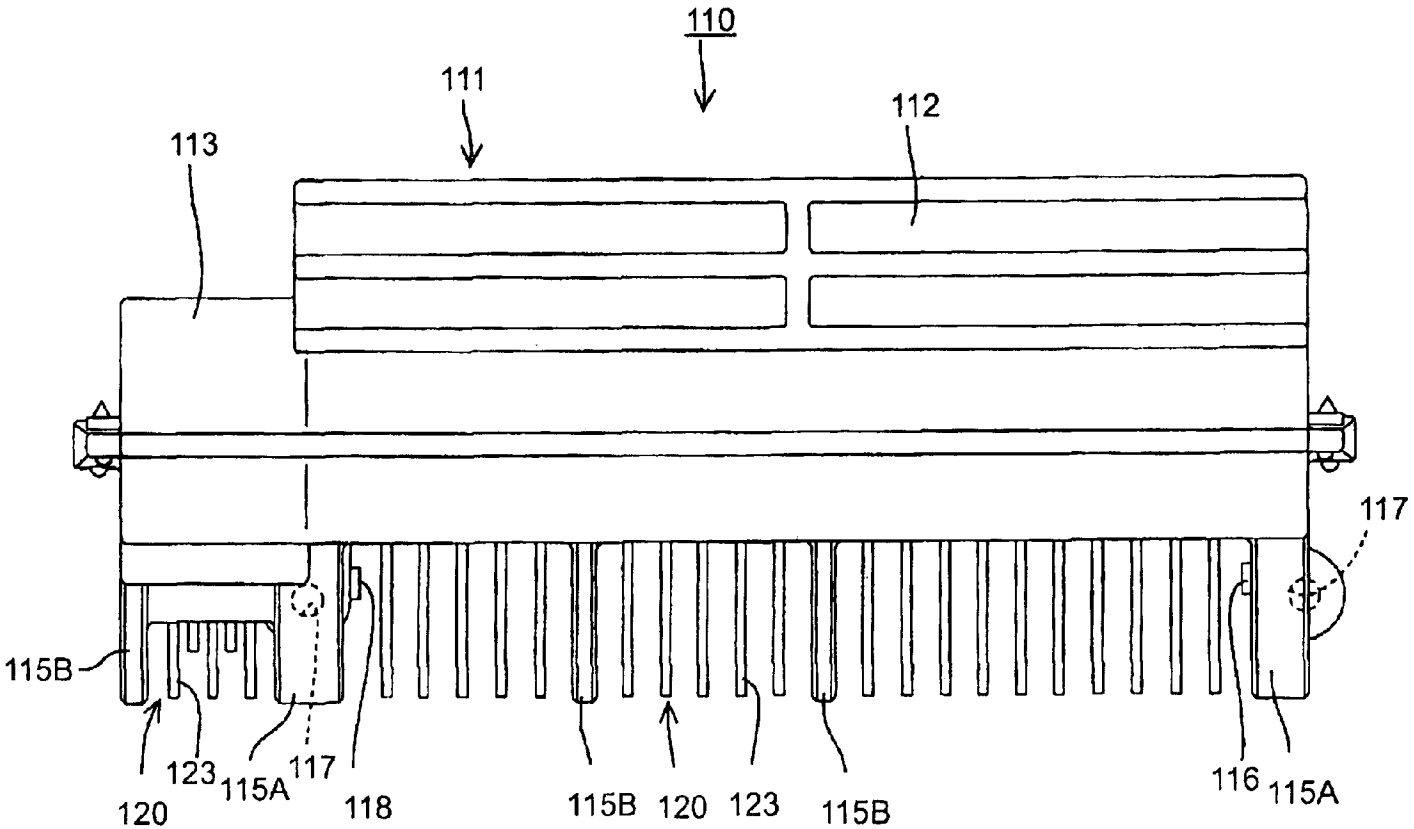
FIG. 24 is a plan view of the circuit board connector.
Figure 25:
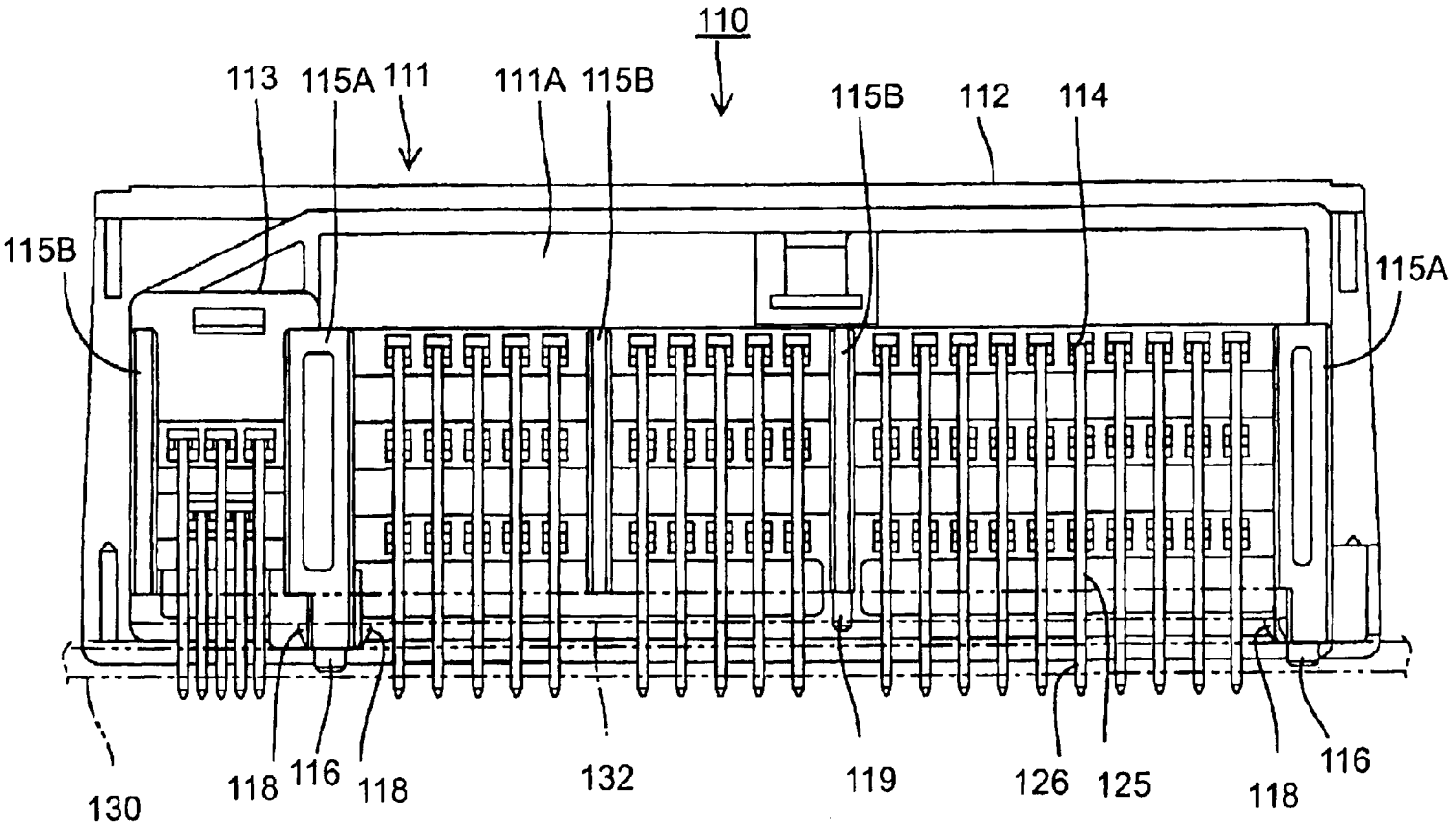
FIG. 25 is a rear view of the circuit board connector.
Figure 26:
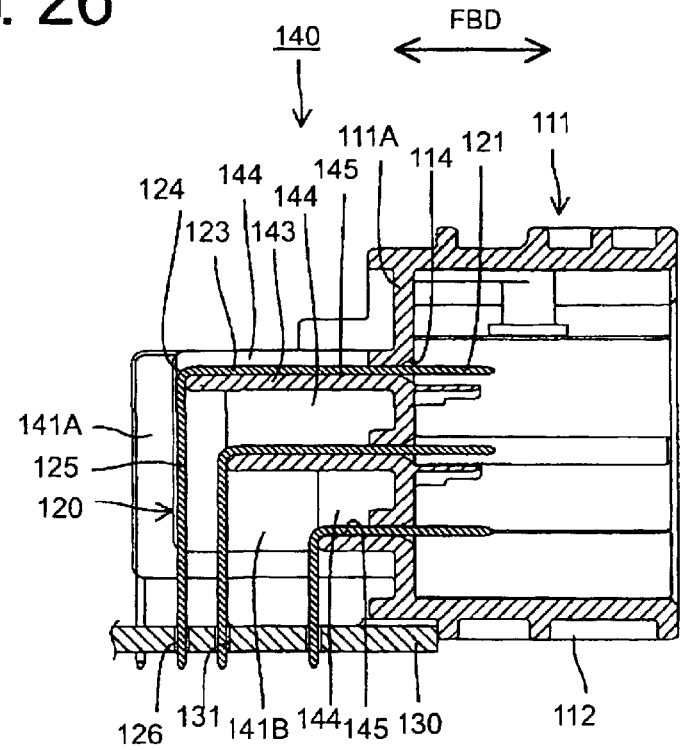
FIG. 26 is a longitudinal section of a circuit board connector according to a further preferred embodiment.
Figure 27:
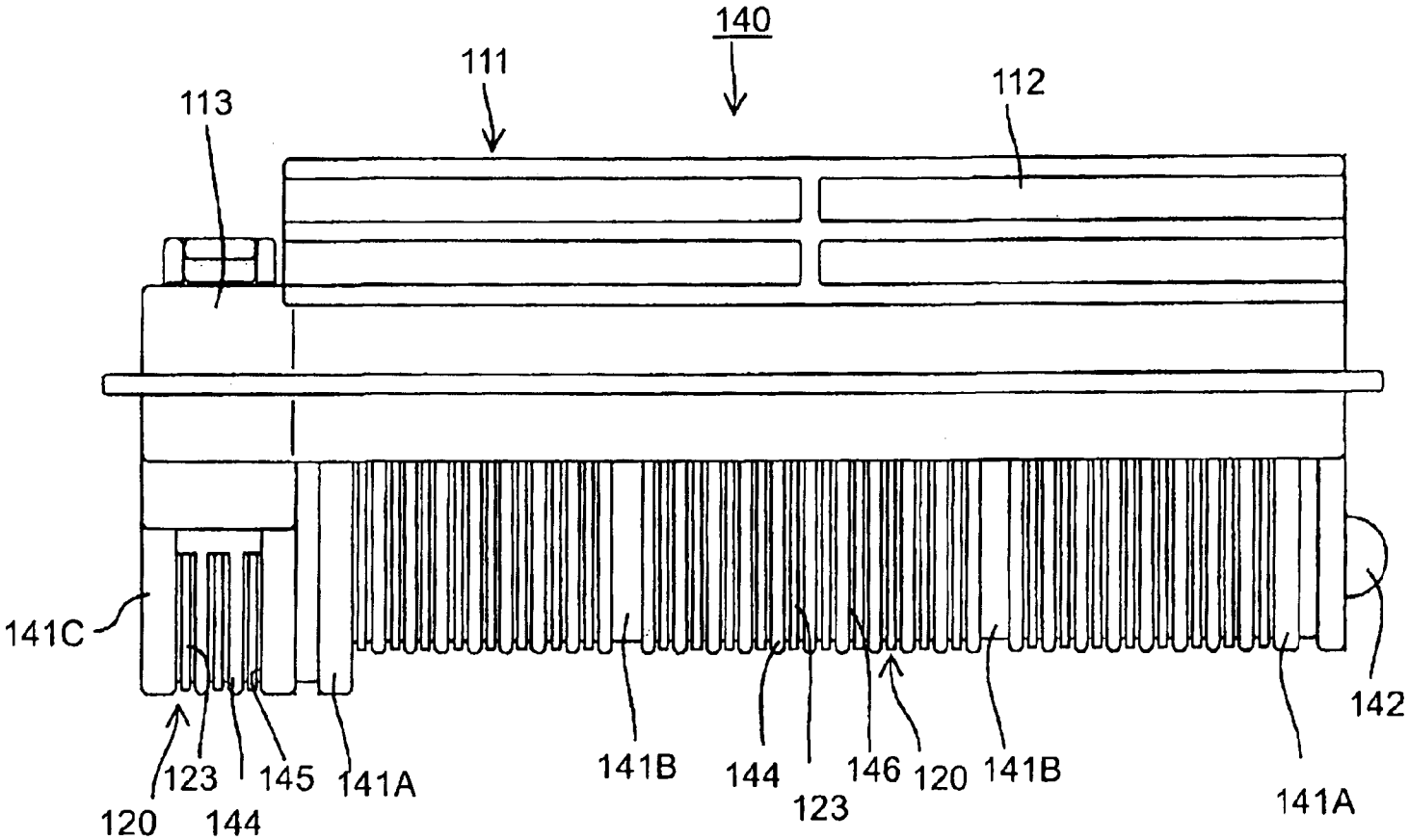
FIG. 27 is a plan view of the circuit board connector of FIG. 26.
Figure 28:
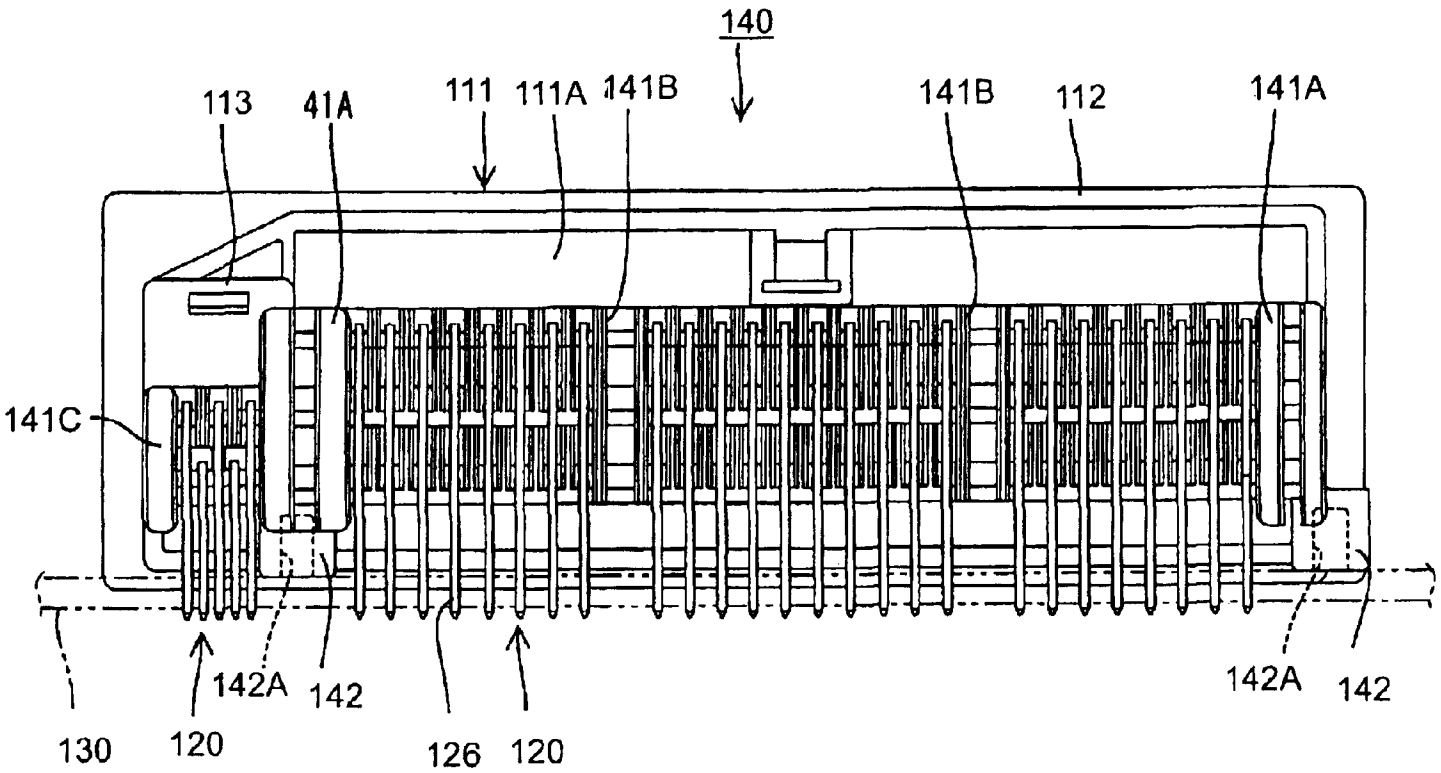
FIG. 28 is a rear view of the circuit board connector of FIG. 26.
Figure 29:
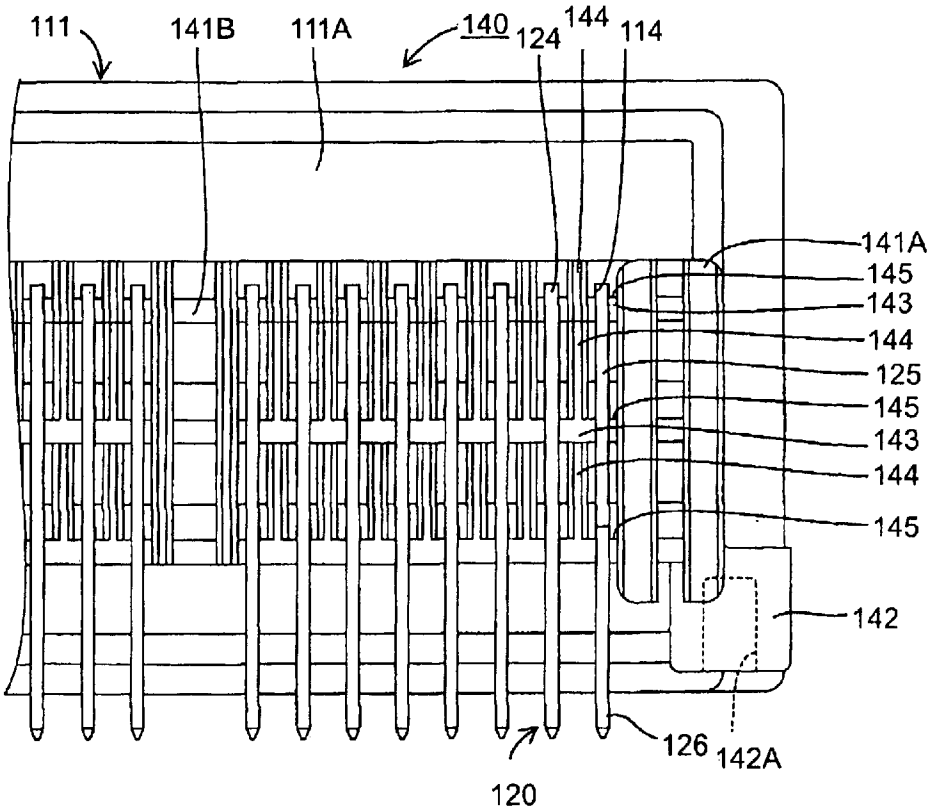
FIG. 29 is a partial enlarged rear view of the circuit board connector of FIG. 26.

The female connector can be pressed against the receptacle 53 with the engaging surface thereof faced up. However, the insertion preventing walls 26 of the holder 11 interfere with the opening edge of the receptacle 53, as shown in FIG. 19, and prevent the female connector 10 from being fit deeply into the receptacle 53. Thus, the female connector 10 does not contact the male terminal fittings 52 in the receptacle 53. FIG. 19 shows a case where the female connector 10 is pressed against the receptacle 53 from the bottom wall 13. The insertion of the female connector 10 also can be prevented when the female connector 10 is pressed against the receptacle 53 from the side wall 14 or when the female connector 10 is pressed in an oblique posture as shown in FIG. 20 with the engaging surface faced up. In the case shown in FIG. 20, a corner of the female connector 10 does not contact the male terminal fittings 52 in the receptacle 53. The upper wall 12 and the lever 40 bulge out at an upper part of the rear surface of the female connector 10. Thus, the female connector 10 cannot fit into the receptacle 53 from the upper wall 12. Further, when the female connector 10 is pressed against the receptacle 53 in such a posture where the engaging surface is faced sideways (including oblique orientation), the catch 24 engages the opening edge of the receptacle 53, as shown in FIG. 21, to prevent the female connector 10 from being fit into the receptacle 53.

A further embodiment of the invention is described with reference to FIGS. 22 to 25. A circuit board connector 110 of this embodiment is comprised of a housing 111 to be fixed to a circuit board 130 and terminal fittings 120 mounted into the housing 111. The housing 111 is made e.g. of a synthetic resin, and has first and second receptacles 112 and 113 arranged substantially side by side on the front surface of the housing 111. The first receptacle 112 is a wide substantially rectangular tube and the second receptacle 113 is a smaller rectangular tube smaller than the first receptacle 112. Mating connectors (not shown) are fit into the respective receptacles 112, 113 from the front. The housing 111 has a rear wall 111A at the back end surfaces of the respective receptacles 112, 113. The rear wall 111A has a plurality of terminal mount holes 114 into which the terminal fittings 120 are pressed. The terminal mount holes 114 are arranged transversely at a specified interval in upper, middle and lower rows in the first receptacle 112 and in upper and lower rows in the second receptacle 113.

Each terminal fitting 120 is formed by bending a long narrow metallic piece substantially into an L-shape. A horizontal section thereof is inserted from behind through the corresponding terminal mount hole 114 and is held therein. Ends of the terminal fittings 120 project from the terminal mount holes 114 into the receptacles 112, 113 to define tabs 121 that can be connected electrically with corresponding female terminal fittings of the mating connector fit into the receptacles 112, 113. A section of each terminal fitting 120 that extends back from the housing 111 has horizontal and vertical portions 123 and 125 and a bend 124 therebetween. The horizontal portion 123 extends substantially along forward and backward directions FBD and the vertical portion 125 is bent down substantially at a right angle from the bend 124. The horizontal portions 123 of the terminal fittings 120 in the higher rows are longer and the corresponding vertical portions 125 are spaced farther from the terminal mount holes 114. The bottom ends of the vertical portions 125 define board connecting portions 126 that are inserted through through holes 131 in the circuit board 130 for electrical connection with circuits (not shown) on the circuit board 130 e.g. by soldering, welding, spring-type connection, clamping or the like connecting means.

Five terminal protection walls 115A, 115B extend back from the rear surface of the housing 111 and define substantially vertical plates arranged substantially normal to the forward and backward directions FBD. The respective terminal protection walls 115A, 115B are spaced apart at specified intervals so that the terminal fittings 120 are located between two adjacent terminal protection walls 115A, 115B. The respective terminal protection walls 115A, 115B are substantially rectangular. Upper ends of the terminal protection walls 115A, 115B are higher than the horizontal portions 123 of the terminal fittings 120 and the rear ends of the terminal protection walls 115A, 115B are more backward than the vertical portions 125. Thus, most of the horizontal and vertical portions 123 and 125 of the respective terminal fittings 120 are covered by the terminal protection walls 115A, 115B from the left and right sides, and only the leading ends of the vertical portions 125 are below the terminal protection walls 115A, 115B. Two terminal protection walls 115A are thicker than the other terminal protection walls 115B. A mount projection 116 and an internally threaded hole 117 are formed at the bottom end of each terminal protection wall 115A. The mount projection 116 is fit into a mount hole (not shown) in the circuit board 130 and the internally threaded hole 117 engageable with a screw (not show) inserted through the circuit board 130. An alignment plate 132 is mounted in contact with bottom portions of the terminal protection walls 115A, 115B. A locking claw 118 is formed at the bottom end of each terminal protection wall 115A for locking the alignment plate 132, and a positioning pin 119 projects at the bottom end of one of the terminal protection walls 115B for engaging an engaging hole (not shown) of the alignment plate 132. The alignment plate 132 is formed with positioning holes 133 through which the leading ends of the respective vertical portions 125 are inserted.

The circuit board connector 110 is assembled by pressing the respective terminal fittings 120 into the terminal mount holes 114 from behind. The rearwardly extending sections of the terminal fittings 120 then are bent down at substantially right angles into an L-shape to define the bends 124 and the vertical portions 125. The alignment plate 132 then is mounted at the bottoms of the terminal protection walls 115A, 115B while the leading ends of the respective vertical portions 125 are inserted through the positioning holes 133 of the alignment plate 132. In this way, the assembling of the circuit board connector 110 is completed.

According to this embodiment, the terminal protection walls 115A, 115B on the rear surface of the housing 111 prevent the deformation of the terminal fittings 120.

A further preferred embodiment of the present invention is described with reference to FIGS. 26 to 29. A circuit board connector 140 of this embodiment is constructed similar to that of the previous embodiment. Hence, only parts different from those of the previous embodiment are mainly described and no repeated description is given on the parts having the same functions as those of the previous embodiment by identifying them by the same reference numerals.

Five terminal protection walls 141A, 141B, 141C extend back from the rear surface of a housing 111 and define substantially vertical plates arranged substantially normal to the forward and backward direction FBD. The respective terminal protection walls 141A, 141B, 141C are spaced apart at specified intervals so that terminal fittings 120 are located between two adjacent terminal protection walls 141A, 141B, 141C. The terminal protection walls 141A, 141B are such that two spaced apart vertical plates are coupled by a plurality of horizontal connecting plates. The terminal protection walls 141A, 141B, 141C are substantially rectangular in side view. Upper ends of the terminal protection walls 141A, 141B, 141C are higher than horizontal portions 123 of the terminal fittings 120 and the rear ends of the terminal protection walls 141A, 141B, 141C are more backward than vertical portions 125. Thus, the horizontal and vertical portions 123 and 125 of the respective terminal fittings 120 are mostly covered by the terminal protection walls 141A, 141B, 141C from the left and right sides, and only the leading ends of the vertical portions 125 are more downward than the terminal protection walls 141A, 141B, 141C. Two terminal protection walls 141A are thicker than the other terminal protection walls 141B, 141C, and mounting portions 141 project at the bottom ends thereof for placement on the circuit board 130. Internally threaded holes 142A engageable with screws (not shown) inserted through the circuit board 130 are formed in the lower surfaces of the mounting portions 142.

Substantially horizontal supporting walls 143 are formed in the respective rows between two adjacent terminal protection walls 141A, 141B, 141C and extend along the lower surfaces of the horizontal portions 123 of the respective terminal fittings 120. Partition walls 144 extend from the upper surface of each supporting wall 143 to partition the adjacent horizontal portions 123. The horizontal portion 123 of each terminal fitting 120 is positioned in a positioning groove 145 defined by two adjacent partition walls 144 and the supporting wall 143. Upper ends of the partition walls 144 in the lower row are coupled to the lower surfaces of the supporting walls 143 in the middle row. The lengths of the respective positioning grooves 145 substantially equal the lengths of the horizontal portions 123 of the corresponding terminal fittings 120, and the rear ends of the supporting walls 143 are rounded to extend along the inner surfaces of bends 124.

The circuit board connector 140 is assembled by pressing the respective terminal fittings 120 into terminal mount holes 114 from a terminal inserting side, preferably from the front. The terminal fittings 120 then are bent substantially normal into L-shapes. The horizontal portions 123 are held in the positioning grooves 145, and the terminal fittings 120 are bent down at the rear ends of the supporting walls 143 to form the bends 124.

The horizontal portions 123 are prevented from downward, leftward and/or rightward deformations and the terminal fittings 120 are aligned with higher precision since the horizontal portions 123 of the respective terminal fittings 120 are positioned in the positioning grooves 145. Further, the number of parts is reduced because the alignment plate is omitted.

Figure 30:
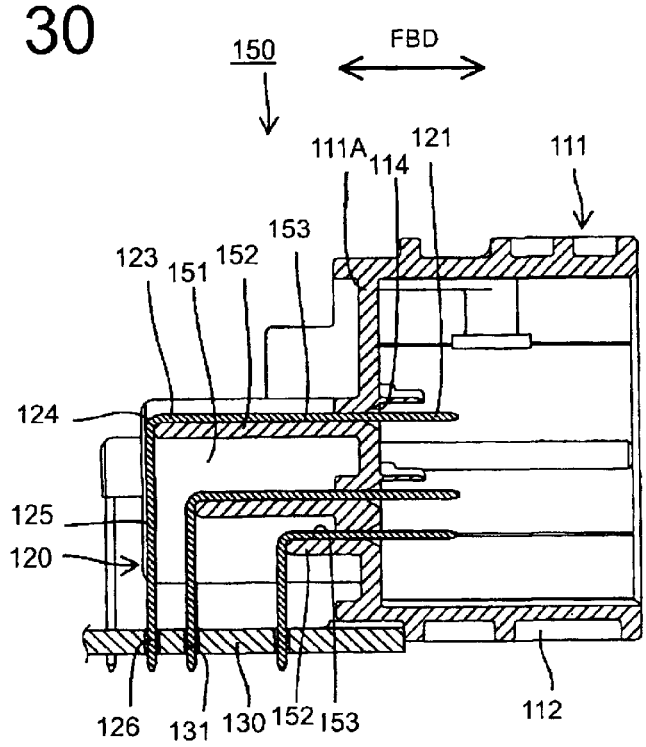
FIG. 30 is a longitudinal section of a circuit board connector according to a further preferred embodiment.
Figure 31:
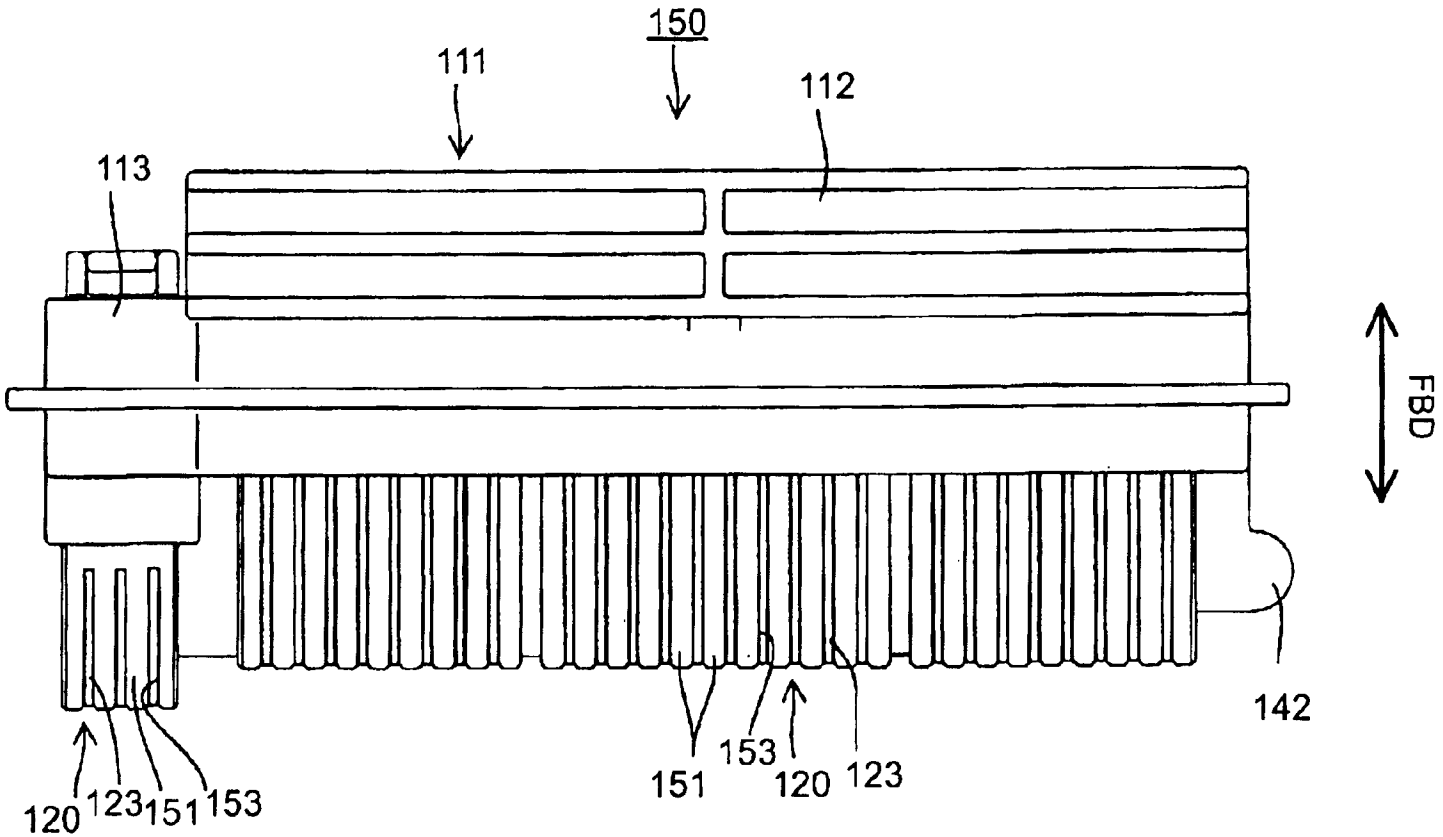
FIG. 31 is a plan view of the circuit board connector of FIG. 30.
Figure 32:
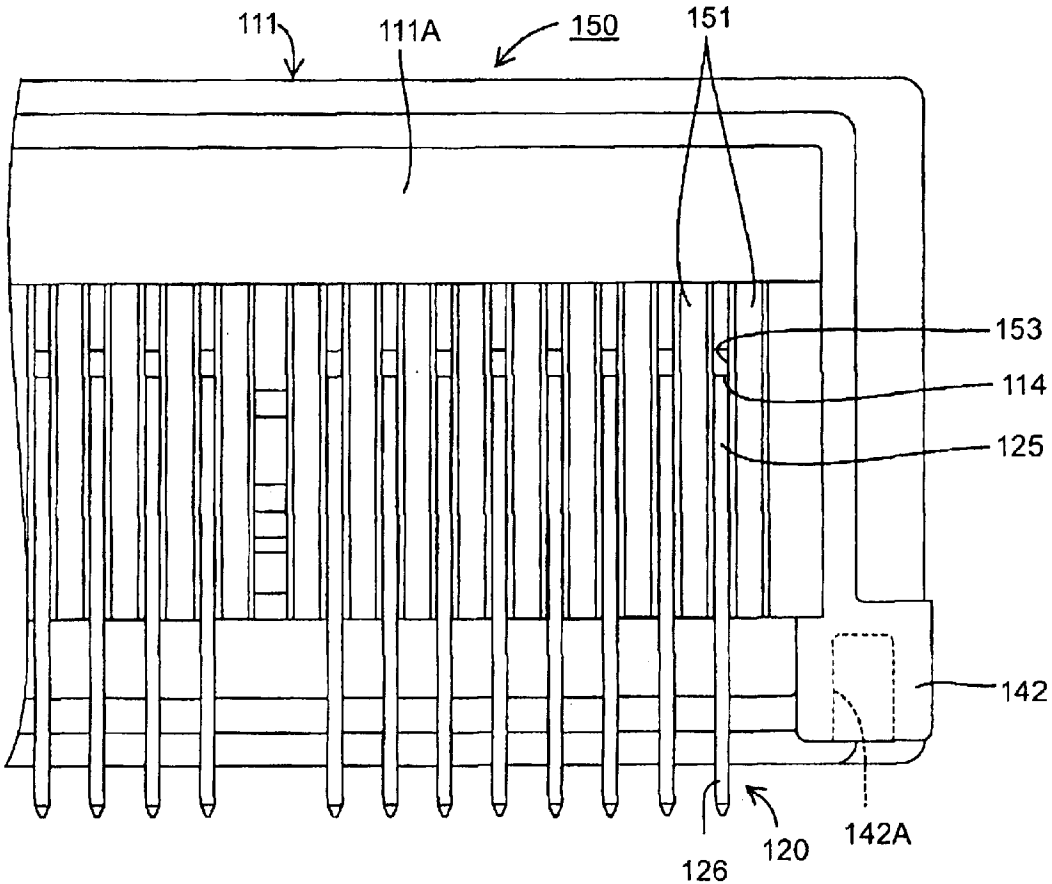
FIG. 32 is a partial enlarged rear view of the circuit board connector of FIG. 31.

A further embodiment of the present invention is described with reference to FIGS. 30 to 32. A circuit board connector 150 of this embodiment is similar to those of the previous embodiments. Hence, only parts different from those of the previous embodiments are described and no repeated description is given on the parts having the same functions as those of the previous embodiments by identifying them by the same reference numerals.

Vertical alignment walls 151 extend back from the rear surface of a housing 111 and are arranged substantially normal to the forward and backward directions FBD. The terminal fittings 120 are located individually between the adjacent alignment walls 151. The alignment walls 151 are substantially rectangular in side view. Upper ends of the alignment walls 151 are higher than horizontal portions 123 of the terminal fittings 120 located therebetween and the rear ends of the alignment wall 151 are farther back than vertical portions 125. Thus, the horizontal portions 123 and the vertical portions 125 of the respective terminal fittings 120 are mostly covered by the alignment walls 151 from left and right sides, and only the leading ends of the vertical portions 125 are farther down than the alignment walls 151. Horizontal supporting walls 152 are formed in each row between adjacent alignment walls 151 and extend along the lower surfaces of the horizontal portions 123 of the respective terminal fittings 120. The horizontal portion 123 of each terminal fitting 120 is accommodated in a positioning groove 153 defined by a pair of adjacent alignment walls 151 and the supporting wall 152. The lengths of the respective positioning grooves 153 substantially equal the lengths of the horizontal portions 123 of the corresponding terminal fittings 120, and the rear ends of the supporting walls 152 are so rounded to extend along the inner surfaces of bends 124. Spacing between the adjacent alignment walls 151 is slightly larger than the width of the terminal fittings 120, and the horizontal portions 123 and the vertical portions 125 of the terminal fittings 120 located between the alignment walls 151.

According to this embodiment, the terminal fittings 120 can be aligned with even higher precision since the vertical portion 125 closer to the leading end of each terminal fitting 120 than the horizontal portion 123 is held between a pair of alignment walls 151 at both left and right sides. Further, the number of parts can be reduced as compared to a case where a separate member such as an alignment plate is assembled with the housing to position the terminal fittings.

The invention is not limited to the above described and illustrated embodiments. For example, the following embodiments are also embraced by the technical scope of the present invention as defined by the claims. Beside the following embodiments, various changes can be made without departing from the scope and spirit of the present invention as defined by the claims.

The lever-type connector is a divided connector in the first embodiment. However, the invention also is applicable to lever-type connectors other than divided connectors. Further, the lever may have a U-shape to cross over the housing. In such a case, the unlocking rib and the insertion preventing rib may be on both upper and lower surfaces of the receptacle.

The housing to be fit into the receptacle of the mating housing is the holder of the divided connector with the lever in the first embodiment. However, the invention is also applicable to types of connectors other than lever-type connectors and divided connectors.

According to the invention, the guide ribs of the first embodiment may be formed on both upper and bottom surfaces of one housing to provide catches on both surfaces.

The invention of the first embodiment has been described with reference to a lever as a preferred movable member. However, the invention is also applicable to other substantially linearly movable members or arcuately movable members.

The terminal fittings are connected with the circuit board by soldering in the foregoing embodiment. However, terminal fittings of press-fit type to be connected with the circuit board by pressing without soldering may be used according to the invention.

Although five terminal protection walls are provided in the first and second embodiments, it is sufficient to provide a pair of terminal protection walls at the opposite sides of the housing.

What is claimed is:

1. A connector, comprising:

a first housing;

a movable member movably mounted on the first housing for movement between an initial position and an ending position, the movable member being formed with a cam means;

a locking means for releasably locking the moveable member in the initial position; and a second housing formed with a receptacle configured for receiving the first housing, a mating cam means formed in the receptacle for engaging the cam means, at least one unlocking rib projecting from an inner surface of the receptacle, the unlocking rib being disposed and configured for canceling a locked state effected by the locking means when the first housing is fit lightly into the receptacle with the movable member locked at the initial position by the locking means, wherein the two housings are pulled toward each other and properly connected by a cam action of the cam means and the mating cam means when the movable member is moved to the ending position.

2. The connector of claim 1, wherein the receptacle is a wide rectangular tube, and wherein the unlocking rib projects from an inner surface of the receptacle along a longer side.

3. The connector of claim 1, wherein the unlocking rib is near one side of the receptacle, at least one insertion preventing rib projecting from a side of the receptacle substantially opposite from the side having unlocking rib, the movable member being formed with an escape groove for receiving the insertion preventing rib.

4. The connector of claim 3, further comprising at least one rib insertion groove formed in an outer wall of the first housing for receiving the insertion preventing rib.

5. The connector of claim 3, wherein the movable member is a lever rotatably mounted on the first housing.

6. The connector of claim 1, wherein the first housing is a frame with accommodating chambers for accommodating auxiliary connectors.

7. The connector of claim 1, wherein an insertion preventing wall is formed integrally on a rear surface of the first housing with respect to a fitting direction and projects back from a widthwise end portion for preventing the first housing from being fit into the receptacle from a side different from an engaging surface thereof.

8. The connector of claim 7, wherein the movable member comprises a lever for connecting the housings by a cam action when the second housing is mounted on the first housing the lever being substantially in the form of a single plate extending along one end surface of the first housing with respect to a height direction, and the insertion preventing wall preventing the insertion of the first housing into the receptacle from a surface opposite from the movable member.

9. The connector of claim 1, further comprising at least one corresponding groove formed in the inner surface of the receptacle at least one guide rib extending substantially along forward and backward directions on a lateral portion of one end surface of the first housing with respect to height direction for engaging the groove, a step-shaped catch being formed by arranging the guide rib at a position spaced from a lateral end of the first housing.

* * * * *